US007331798B2

(12) United States Patent
Yoshida et al.

(10) Patent No.: US 7,331,798 B2
(45) Date of Patent: Feb. 19, 2008

(54) CONNECTING ELEMENT AND CIRCUIT CONNECTING DEVICE USING THE CONNECTING ELEMENT

(75) Inventors: Shin Yoshida, Miyagi-ken (JP); Taiji Okamoto, Miyagi-ken (JP); Koji Dono, Miyagi-ken (JP); Nobuyuki Okuda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/452,809

(22) Filed: Jun. 13, 2006

(65) Prior Publication Data

US 2007/0020962 A1 Jan. 25, 2007

(30) Foreign Application Priority Data

Jul. 20, 2005 (JP) ..... 2005-210037
Feb. 8, 2006 (JP) ..... 2006-030898

(51) Int. Cl.
*H01R 12/00* (2006.01)

(52) U.S. Cl. ..... 439/67; 439/74

(58) Field of Classification Search ..... 439/67, 439/74, 95

See application file for complete search history.

(56) References Cited

U.S. PATENT DOCUMENTS

| | | | | |
|---|---|---|---|---|
| 4,901,205 | A * | 2/1990 | Landis et al. | 361/818 |
| 6,358,064 | B2 * | 3/2002 | Szalay et al. | 439/67 |
| 6,517,362 | B2 | 2/2003 | Hirai et al. | |
| 6,535,394 | B1 * | 3/2003 | Hirzmann | 361/761 |
| 6,869,291 | B2 * | 3/2005 | Norland et al. | 439/67 |
| 7,117,592 | B2 * | 10/2006 | Yoshida | 29/883 |
| 7,220,133 | B2 * | 5/2007 | Matsuo et al. | 439/67 |
| 2002/0098726 | A1 * | 7/2002 | Deguchi | 439/92 |

* cited by examiner

*Primary Examiner*—Neil Abrams
*Assistant Examiner*—Phuongchi Nguyen
(74) *Attorney, Agent, or Firm*—Beyer Weaver LLP

(57) ABSTRACT

A connecting element includes a support member, a flexible substrate wrapped around the support member, and elastic contacts provided on the flexible substrate. A positioning hole is formed in the support member. A first positioning component is positioned and soldered on a metal layer formed on a motherboard, and a second positioning component is positioned and soldered on a metal layer formed on an electronic component. The first positioning component is inserted into the positioning hole in the connecting element, and the second positioning member is fitted to the first positioning component. Accordingly, the connecting element is positioned with respect to both the motherboard and the electronic component.

15 Claims, 13 Drawing Sheets

CONNECTING ELEMENT AND CIRCUIT CONNECTING DEVICE USING THE CONNECTING ELEMENT

BACKGROUND OF THE INVENTION

1. Field of the Invention

The present invention relates to a connecting element having a plurality of elastic contacts to be connected to conducting portions of a circuit component, such as a circuit board and an IC package, and a circuit connecting device that positions and connects the connecting element to the circuit component.

2. Description of the Related Art

Japanese Unexamined Patent Application Publication No. 2002-175859, which corresponds to U.S. Pat. No. 6,517,362, discloses a connecting element in which a plurality of spiral elastic contacts are provided on one side of a plate-shaped support member and a plurality of fixed contacts are provided on the other side of the support member, the fixed contacts being conductively connected to the respective elastic contacts in one-to-one correspondence.

The fixed contacts of the connecting element are brought into contact with respective conducting portions provided on a motherboard. Then, in that state, spherical connecting terminals of an IC package are pressed against the elastic contacts of the connecting element. Accordingly, the spherical connecting terminals of the IC package are individually connected to the respective conducting portions on the motherboard via the connecting elements.

According to this invention, the IC package can be replaced since the spherical connecting terminals of the IC package are connected to the elastic contacts of the connecting element by being elastically pressed against the elastic contacts.

When the connecting element described in Japanese Unexamined Patent Application Publication No. 2002-175859 is used, it is necessary to fix the connecting element to the motherboard such that the fixed contacts provided on the connecting element are accurately positioned on the respective conducting portions of the motherboard in one-to-one correspondence. In addition, when the IC package is placed on the connecting element, it is necessary to position the IC package such that the spherical terminals provided on the IC package are positioned on the respective elastic contacts of the connecting element in one-to-one correspondence.

Japanese Unexamined Patent Application Publication No. 2002-175859 discloses a structure in which the motherboard has a holder for holding the IC package at both sides thereof and the IC package is positioned and held by this holder. However, a structure for positioning the plate-shaped support member of the connecting element on the motherboard is not clearly described. In this type of circuit connecting device, to accurately connect the terminals provided on the IC package to the respective conducting portions provided on the motherboard, it is necessary to accurately position and fix the connecting element to the motherboard.

In addition, also when a connecting element having terminals on top and bottom faces thereof is mounted on a motherboard at an arbitrary position and an IC package or the like is mounted on the connecting element so that the motherboard and the IC package or the like are conductively connected to each other by the connecting element, it is necessary to accurately position and fix the connecting element to the motherboard. However, when the size of the components is reduced and the circuit density is increased, the size of the contacts provided on the connecting element is reduced and the density of the contacts is increased. Therefore, it becomes difficult to position the connecting element such that the contacts on the connecting element reliably face the respective conducting portions on the motherboard.

SUMMARY OF THE INVENTION

To solve the above-described problems, an object of the present invention is to provide a connecting element having elastic contacts that can be accurately positioned with respect to circuit components, such as a circuit board, an IC package, and other electronic components, and a circuit connecting device using the connecting element.

According to the present invention, a connecting element includes a support member having an opposing face for connection and a plurality of elastic contacts provided on the opposing face. The support member has a positioning hole, a positioning recess, or a positioning projection in a region free from the elastic contacts.

In the connecting element according to the present invention, a hole, a recess, or a projection is formed directly on the support member on which the elastic contacts are provided. Therefore, the connecting element can be positioned with respect to a circuit component, such as a circuit board and an IC package, using the hole, the recess, or the projection as a reference. Accordingly, the elastic contacts can be reliably caused to face conducting portions provided on the circuit component.

According to the present invention, the opposing face may be provided on each of two opposite sides of the support member and the elastic contacts may include a first group of elastic contacts provided on one of the opposing faces and a second group of elastic contacts provided on the other one of the opposing faces, the first group of elastic contacts being conductively connected to the second group of elastic contacts.

In the above-described structure, the first group of elastic contacts, the second group of elastic contacts, and a wiring pattern for conductively connecting the first group of elastic contacts to the second group of elastic contacts may be provided on one side of a flexible substrate, the flexible substrate being fixed to the support member in a bent fashion so that the first group of elastic contacts are positioned on the one of the opposing faces and the second group of elastic contacts are positioned on the other one of the opposing faces.

Alternatively, according to the present invention, the opposing face may be provided at each of two opposite sides of the support member, and the elastic contacts may be provided on one of the opposing faces. In addition, a plurality of fixed contacts may be provided on the other one of the opposing faces, the elastic contacts being conductively connected to the fixed contacts.

In the above-described structure, the elastic contacts, the fixed contacts, and a wiring pattern for conductively connecting the elastic contacts to the fixed contacts may be provided on one side of a flexible substrate, the flexible substrate being fixed to the support member in a bent fashion so that the elastic contacts are positioned on the one of the opposing faces and the fixed contacts are positioned on the other one of the opposing faces.

In the connecting element having the above-described structure, a single flexible substrate is used to arrange the elastic contacts and the fixed contacts that are conductively connected to each other on the two opposing faces of the support member. Therefore, the structure can be simplified.

According to the present invention, preferably, positioning means is provided for positioning the flexible substrate with respect to the support member and fixing the flexible substrate to the support member.

When the flexible substrate is positioned and fixed to the support member by the positioning means, the relative positions between the hole, the recess, or the projection on the support member and the elastic contacts or the fixed contacts can be determined with high accuracy.

A circuit connecting device according to the present invention includes any one of the above-described connecting elements and a positioning component for positioning the connecting element. The positioning component is attachable to a circuit component having conducting portions to which the elastic contacts are connected.

In the circuit connecting device, the positioning component and the support member are fitted to each other so that the connecting element is positioned with respect to the circuit component.

Accordingly, the positioning component has a portion that is fitted into the positioning hole formed in the support member or a hole into which the projection provided on the support member is fitted.

For example, a circuit connecting device according to the present invention includes the connecting element; a first positioning component for positioning the connecting element; and a second positioning component for positioning the connecting element. The support member has a positioning hole to which the first positioning component or the second positioning component is fitted and the first positioning component and the second positioning are capable of being fitted to each other. In addition, the first positioning component is attachable to a first circuit component having conducting portions to which the first group of elastic contacts are connected and the second positioning component is attachable to a second circuit component having conducting portions to which the second group of elastic contacts are connected.

Alternatively, a circuit connecting device according to the present invention includes the connecting element; a first positioning component for positioning the connecting element; and a second positioning component for positioning the connecting element. The support member has a positioning hole to which the first positioning component or the second positioning component is fitted, and the first positioning component and the second positioning are capable of being fitted to each other. In addition, the first positioning component is attachable to a first circuit component having conducting portions to which the elastic contacts are connected and the second positioning component is attachable to a second circuit component having conducting portions to which the fixed contacts are connected.

Since the circuit connecting device includes the first positioning component and the second positioning component that are capable of being fitted to each other, the connecting element can be accurately positioned with respect to circuit components, such as a circuit board and an IC package, that face each other using the positioning components and the positioning hole formed in the support member.

In the circuit connecting device according to the present invention, preferably, the circuit component has a metal layer for positioning, the positioning component being soldered on the metal layer, and the connecting element is positioned and attached to the circuit component by the positioning component. Alternatively, preferably, each of the first circuit component and the second circuit component has a metal layer for positioning, the first positioning component and the second positioning component being soldered on the metal layer on the first circuit component and the metal layer on the second circuit component, respectively, and the first positioning component and the second positioning component are fitted to each other such that the connecting element is positioned and attached between the first circuit component and the second circuit component.

In such a structure, the positioning components can be fixed to the circuit components by soldering, and the structure for positioning the connecting element can be easily obtained with high accuracy.

In this case, preferably, the conducting portions and the metal layer for positioning are made of the same metal material in the same process.

When the conducting portions and the metal layer are formed on the circuit components in the same process, the relative positions between the conducting portions and the metal layer can be set with high accuracy. As a result, positional relationship between the positioning component soldered on the metal layer and the conducting portions can be set with high accuracy.

In addition, according to the present invention, preferably, the positioning component includes fixing bases that face each other across an inner space and that have a predetermined width in an opposing direction in which the fixing bases face each other and the metal layer provided on the circuit component includes portions having a predetermined width and spaced from each other in the opposing direction, the fixing bases being soldered on the portions of the metal layer such that the fixing bases are in surface contact with the portions of the metal layer.

Thus, the positioning component may include the fixing bases that face each other and the metal layer provided on the circuit board may include portions having a predetermined width which are spaced from each other and with which the fixing bases come into surface contact. In such a case, when the fixing bases are soldered on the portions of the metal layer that are spaced from each other, the positioning component can be easily positioned with respect to the middle point between the portions of the metal layer due to the surface tension of the molten solder. More specifically, compared to fixing means that solders the fixing bases that face each other while the fixing bases are in surface contact with an integral metal layer, the positioning function obtained due to the surface tension of the molten solder can be improved.

As described below, the positioning component according to the present invention is not limited to those having an annular fixing base. The positioning component may also be bent in an angular U shape in which fixing bases having a predetermined length face each other across an inner space of the positioning component.

In such a case, preferably, a distance between outer peripheral edges of the portions of the metal layer in the opposing direction is equal to or more than a distance between outer peripheral edges of the fixing bases in the opposing direction, and a distance between inner peripheral edges of the portions of the metal layer in the opposing direction is equal to or less than a distance between inner peripheral edges of the fixing bases in the opposing direction.

However, when the distance between the outer peripheral edges of the portions of the metal layer in the opposing direction is equal to or more than the distance between the outer peripheral edges of the fixing bases in the opposing direction, the distance between the inner peripheral edges of the portions of the metal layer in the opposing direction may be equal to or more than the distance between the inner peripheral edges of the fixing bases in the opposing direction.

Preferably, a difference between the distance between the outer peripheral edges of the portions of the metal layer in the opposing direction and the distance between the outer peripheral edges of the fixing bases in the opposing direction is in the range of 0 mm to 0.3 mm, and a difference between the distance between the inner peripheral edges of the portions of the metal layer in the opposing direction and the distance between the inner peripheral edges of the fixing bases in the opposing direction is in the range of 0 mm to 0.3 mm.

According to the present invention, the positioning component may also include an annular fixing base that is provided so as to surround an inner space and that has a predetermined width and the metal layer provided on the circuit component may have an annular shape with a predetermined width, the fixing base being soldered on the metal layer such that the fixing base is in surface contact with the metal layer.

In this case, preferably, a diameter of an outer peripheral edge of the metal layer is equal to or more than a diameter of an outer peripheral edge of the fixing base, and a diameter of an inner peripheral edge of the metal layer is equal to or less than a diameter of an inner peripheral edge of the fixing base.

However, when the diameter of the outer peripheral edge of the metal layer is equal to or more than the diameter of the outer peripheral edge of the fixing base, the diameter of the inner peripheral edge of the metal layer may be equal to or more than the diameter of the inner peripheral edge of the fixing base.

In this case, preferably, a difference between the diameter of the outer peripheral edge of the metal layer and the diameter of the outer peripheral edge of the fixing base is in the range of 0 mm to 0.3 mm, and a difference between the diameter of the inner peripheral edge of the metal layer and the diameter of the inner peripheral edge of the fixing base is in the range of 0 mm to 0.3 mm.

With respect to the positioning component, a maximum distance between the outer peripheral edges of the fixing bases or the diameter of the outer peripheral edge is 5 mm or less and the weight of the positioning component is 1 g or less. Preferably, the above-mentioned distance or diameter is 3 mm or less and the weight is 0.5 g or less.

According to the present invention, a connecting element having a plurality of elastic contacts or a connecting element having a plurality of elastic contacts and a plurality of fixed contacts can be attached to a circuit component, such as a circuit board, an IC package, and other electronic components, such that the connecting element is accurately positioned with respect to conducting portions provided on the circuit component.

In addition, when the positioning component is soldered on the metal layer provided on the circuit component, the positioning component can be fixed at a predetermined position on the circuit component with high accuracy. Accordingly, the connecting element can be accurately positioned with respect to the circuit component using the positioning component.

BRIEF DESCRIPTION OF THE DRAWINGS

FIG. 14A shows the state in which the first positioning component is displaced and FIG. 14B shows the state in which the first positioning component is positioned;

DESCRIPTION OF THE PREFERRED EMBODIMENTS

Figure 1:
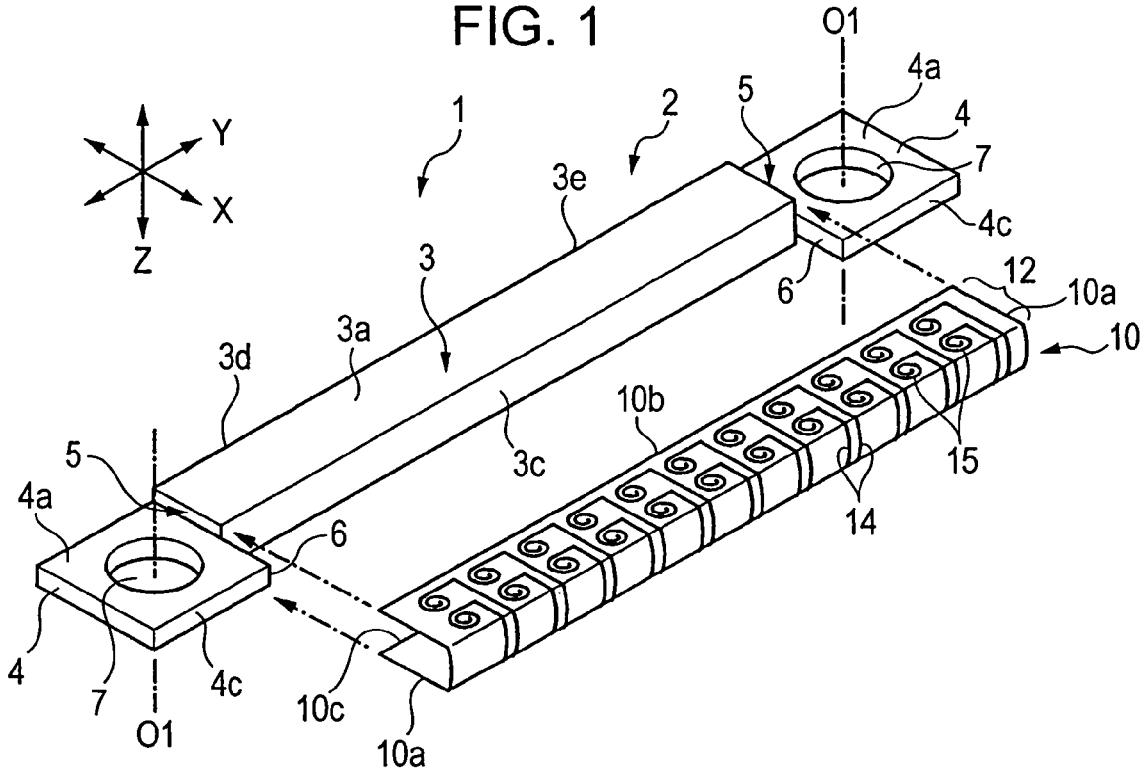
FIG. 1 is an exploded perspective view illustrating a connecting element according to a first embodiment of the present invention.
Figure 2A:
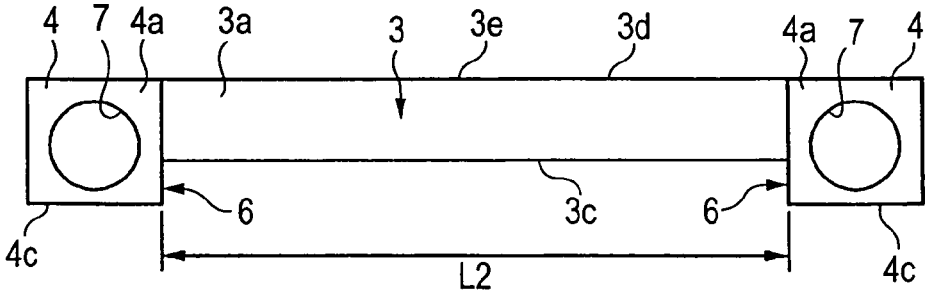
FIGS. 2A and 2B are a plan view and a front view, respectively, of a support member included in the connecting element.
Figure 2B:
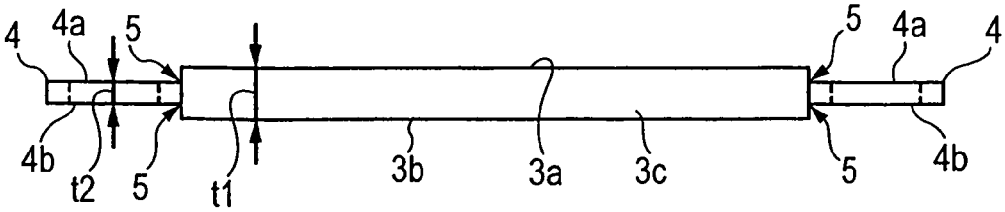
Figure 3:
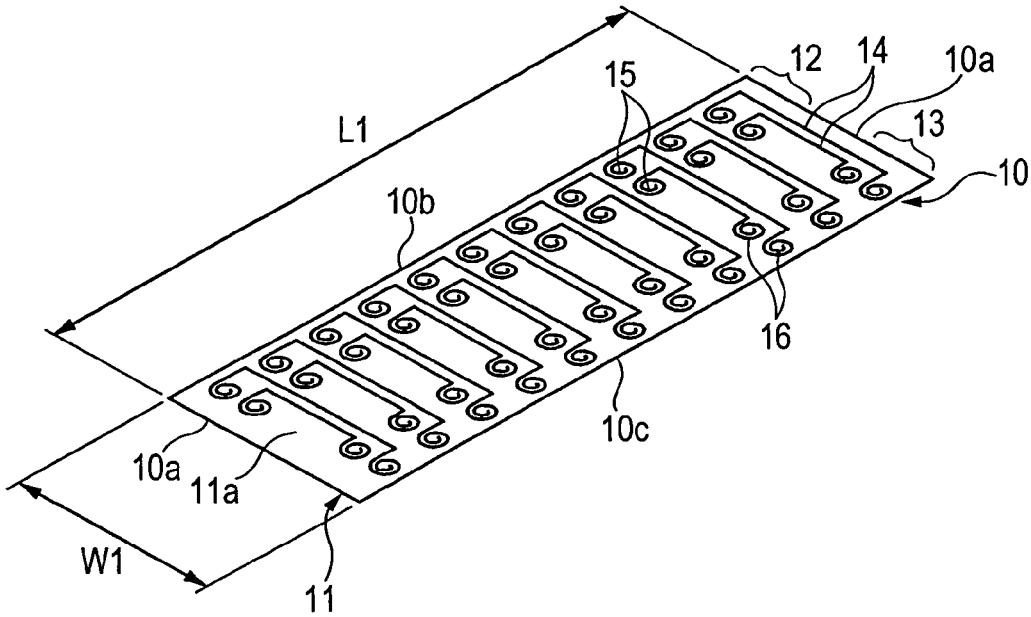
FIG. 3 is a perspective view of a connecting sheet included in the connecting element.
Figure 4:
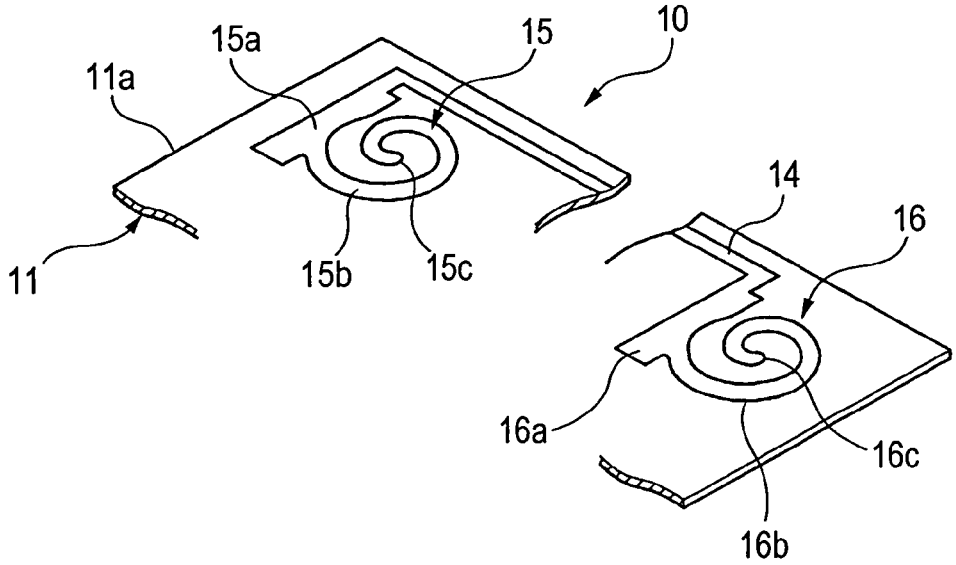
FIG. 4 is an enlarged perspective view illustrating portions of the connecting sheet.

FIG. 1 is an exploded perspective view illustrating a connecting element according to a first embodiment of the present invention. FIGS. 2A and 2B are a plan view and a front view, respectively, of a support member included in the connecting element. FIG. 3 is a perspective view illustrating a connecting sheet included in the connecting element in such a state that the connecting sheet is developed on a plane. FIG. 4 is an enlarged perspective view illustrating portions of the connecting sheet.

Referring to FIG. 1, a longitudinal direction, a width direction, and a thickness direction of a connecting element 1 correspond to Y, X, and Z directions, respectively. In the following description, dimensions in the longitudinal direction, the width direction, and the thickness direction of are called length, width, and thickness, respectively.

The connecting element 1 includes a support member 2. As shown in FIGS. 1, 2A, and 2B, the support member 2 has an elongated plate-like shape with a length greater than a width thereof and a thickness less than the width thereof. The support member 2 is made of a synthetic resin material, such as liquid crystal polymer resin, with which dimensions of each portion can be determined with high accuracy and which has a small coefficient of linear expansion so that the dimensions do not largely vary due to temperature variation. Alternatively, the support member 2 may also be made of polyethylene resin, polyacetal resin, and polyimide resin. In addition, the support member 2 may also be made of elastomer resin that can be elastically deformed.

The support member 2 includes a substrate-holding portion 3. The substrate-holding portion 3 has a first planar opposing face 3*a* facing upward in the Z direction and a second planar opposing face 3*b* facing downward in the Z direction. The first opposing face 3*a* and the second opposing face 3*b* face upward and downward, respectively, i.e., in the opposite directions, and are parallel to each other. However, the first opposing face 3*a* and the second opposing face 3*b* may also have curved surfaces that are slightly convex in the Z direction.

The substrate-holding portion 3 also has a mounting side face 3*c* that continues to both the first opposing face 3*a* and the second opposing face 3*b*. The mounting side face 3*c* is planar and is perpendicular to both the first opposing face 3*a* and the second opposing face 3*b*. Alternatively, the mounting side face 3*c* may also have a curved surface that is slightly convex in the X direction. A back side face 3*d* on the side opposite to the mounting side face 3*c* is planar and is perpendicular to both the first opposing face 3*a* and the second opposing face 3*b*.

Figure 6:
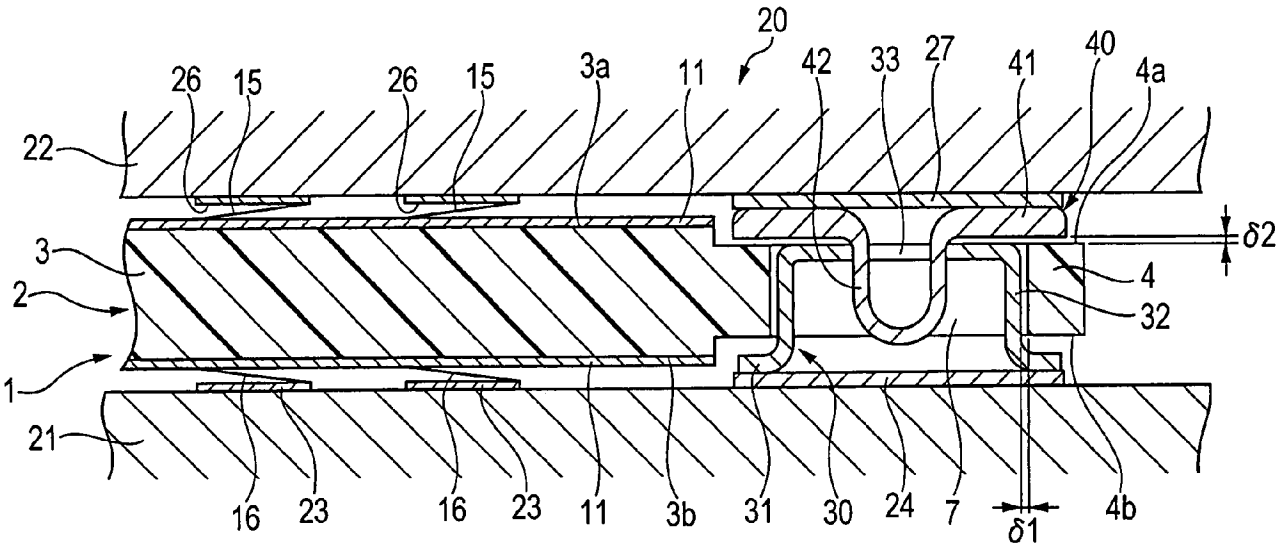
FIG. 6 is a sectional view of a circuit connecting device according to the first embodiment.

The support member 2 also includes mounting portions 4 that are formed integrally with the substrate-holding portion 3 at longitudinal ends of the substrate-holding portion 3. As shown in FIG. 2B, a thickness t2 of the mounting portions 4 is less than a thickness t1 of the substrate-holding portion 3, and step portions 5 are formed at boundaries between the substrate-holding portion 3 and the mounting portions 4. Since the step portions 5 are formed, top faces 4*a* of the mounting portions 4 are lower than the first opposing face 3*a* of the substrate-holding portion 3 by one step and bottom faces 4*b* of the mounting portions 4 are lower than the second opposing face 3*b* of the substrate-holding portion 3 by one step. Therefore, when a first positioning component 30 and a second positioning component 40, which will be described below, are assembled with each of the mounting portions 4, as shown in FIG. 6, the positioning components 30 and 40 can be placed near the top face 4*a* and the bottom face 4*b* of the mounting portion 4. In addition, the first opposing face 3*a* and the second opposing face 3*b* of the substrate-holding portion 3 are prevented from interfering with the positioning components 30 and 40.

As shown in FIGS. 1 and 2A, front faces 4*c* of the mounting portions 4 protrude beyond the mounting side face 3*c* of the substrate-holding portion 3, so that positioning portions 6 that protrude frontward from the mounting side face 3*c* are provided. The positioning portions 6 are planar and are perpendicular to the first opposing face 3*a*, the second opposing face 3*b*, and the mounting side face 3*c*. In addition, the positioning portions 6 face each other and are parallel to each other.

The mounting portions 4 have positioning holes 7 formed therein. The support member 2 is formed by injection molding in which synthetic resin is injected into a mold. Accordingly, relative positions and dimensions of each portion can be determined with high accuracy depending on the processing accuracy of the mold. Therefore, the inner diameter of each positioning hole 7 can be determined with high accuracy. In addition, the relative position between the centerline O1 of each positioning hole 7 and the positioning portion 6, the relative positions between the centerline O1 and the first and second opposing faces 3*a* and 3*b*, the relative position between the centerline O1 and the mounting side face 3*c*, and the relative position between the centerline O1 and the back side face 3*d* are also determined with high accuracy.

As shown in FIG. 1, a connecting sheet 10 is accurately positioned and fixed to the substrate-holding portion 3 in a folded fashion. As shown in FIG. 3, the connecting sheet 10 includes a rectangular flexible substrate 11. A first elastic contact group 12, a second elastic contact group 13, and a wiring pattern 14 are provided on a surface 11*a* of the flexible substrate 11. The wiring pattern 14 connects a plurality of elastic contacts 15 that belong to the first elastic contact group 12 to a plurality of elastic contacts 16 that belong to the second elastic contact group 13 in one-to-one correspondence.

FIG. 4 is an enlarged view illustrating portions of the flexible substrate 11, the elastic contacts 15 and 16, and portions of the wiring pattern 14.

The flexible substrate 11 is formed of an electrically insulative synthetic resin sheet made of polyimide resin or the like, or a non-conductive metal or non-metal sheet. Each of the elastic contacts 15 formed on the surface 11*a* of the flexible substrate 11 includes a fixed portion 15*a* that is fixed to the surface 11*a* and an elastically deformable portion 15*b* having a spiral shape that extends integrally from the fixed portion 15*a*. The elastically deformable portion 15*b* is not fixed to the surface 11*a* of the flexible substrate 11, and has a three-dimensional structure such that the distance from the surface 11*a* is increased toward a spiral center 15*c*. Similar to the elastic contacts 15, each of the elastic contacts 16 includes a fixed portion 16*a*, an elastically deformable portion 16*b* having a spiral shape, and a spiral center 16*c*, and has a three-dimensional structure such that the distance from the surface 11*a* of the flexible substrate 11 is increased toward the spiral center 16*c*.

In the embodiment shown in FIG. 4, the elastic contacts 15 included in the first elastic contact group 12 and the elastic contacts 16 included in the second elastic contact group 13 are formed in the same pattern. Accordingly, the first elastic contact group 12 and the second elastic contact group 13 can be formed in the same process. Therefore, the relative positions between the elastic contacts 15 included in the first elastic contact group 12 and the elastic contacts 16 included in the second elastic contact group 13 can be determined with high accuracy by a thin-film formation process.

The elastic contacts 15 included in the first elastic contact group 12 and the elastic contacts 16 included in the second elastic contact group 13 may also be formed such that the direction of spiral of the elastic contacts 15 is opposite to the direction of spiral of the elastic contacts 16.

The elastic contacts 15 and the elastic contacts 16 are conductive and are capable of generating an elastic force. The elastic contacts 15 and the elastic contacts 16 are made of, for example, a composite of an elastic material, such as nickel (Ni) and nickel-phosphorus alloy (Ni—P), and a conductive metal, such as copper, silver, and gold, that has a low specific resistance. The elastic contacts 15 and the elastic contacts 16 can be formed by etching a thin metal film formed on the surface 11*a* of the flexible substrate 11, or by stamping a metal plate. Alternatively, the elastic contacts 15 and the elastic contacts 16 may also be formed on the surface 11*a* of the flexible substrate 11 by a plating process.

The wiring pattern 14 that connects the elastic contacts 15 to the elastic contacts 16 in one-to-one correspondence is made of a metal material, such as a copper foil, that has a low specific resistance.

The length L1 of the connecting sheet 10 is equal to or slightly smaller than the distance L2 between the positioning portions 6 shown in FIG. 2A that face each other. The difference between the length L1 and the distance L2 is set within a tolerance range necessary for positioning the elastic contacts 15 and 16.

The width W1 of the connecting sheet 10 is set to be equal to or slightly smaller than the sum of the width of the first opposing face 3*a*, the width of the second opposing face 3*b*, and the width of the mounting side face 3*c*. The difference between the width W1 and the sum is set within a tolerance range necessary for positioning the elastic contacts 15 and 16.

As shown in FIG. 1, the connecting sheet 10 is wrapped around the substrate-holding portion 3 of the support member 2. The connecting sheet 10 is attached in such a manner that the first elastic contact group 12 is placed on the first opposing face 3*a* of the substrate-holding portion 3, the second elastic contact group 13 is placed on the second opposing face 3*b* of the substrate-holding portion 3, and an area between the first elastic contact group 12 and the second elastic contact group 13 is in contact with the mounting side face 3*c* of the substrate-holding portion 3. In this manner, the back surface of the flexible substrate 11 of the connecting sheet 10 is fixed to the substrate-holding portion 3 with an adhesive.

With respect to the positional relationship between the elastic contacts 15 and the elastic contacts 16 that are conductively connected to one another in one-to-one correspondence by the wiring pattern 14, the elastic contacts 16 are positioned directly under the corresponding elastic contacts 15 when the connecting sheet 10 is attached to the support member 2.

The connecting sheet 10 is fixed to the support member 2 such that two short sides 10*a* of the connecting sheet 10 come into contact with the positioning portions 6 of the support member 2. Accordingly, the connecting sheet 10 is positioned with respect to the support member 2 in the longitudinal direction (Y direction). In addition, the connecting sheet 10 is fixed to the substrate-holding portion 3 such that one long side 10*b* of the connecting sheet 10 is positioned on an edge 3*e* at a boundary between the first opposing face 3*a* and the back side face 3*d* of the substrate-holding portion 3, and the other long side 10*c* is positioned on an edge at a boundary between the second opposing face 3*b* and the back side face 3*d*. Accordingly, the connecting sheet 10 is positioned with respect to the support member 2 in the width direction (the X direction).

Due to the above-described positioning means, the relative positions between each of the elastic contacts 15 included in the first elastic contact group 12 placed on the first opposing face 3*a*, each of the elastic contacts 16 included in the second elastic contact group 13, and the centerlines O1 of the positioning holes 7 are determined with high accuracy in the longitudinal direction (Y direction) and the width direction (X direction).

Accordingly, when the connecting element 1 is mounted on a circuit component using the positioning holes 7 as references, the elastic contacts 15 and the elastic contacts 16 can be accurately positioned so as to face conducting portions provided on the circuit component.

Figure 5:
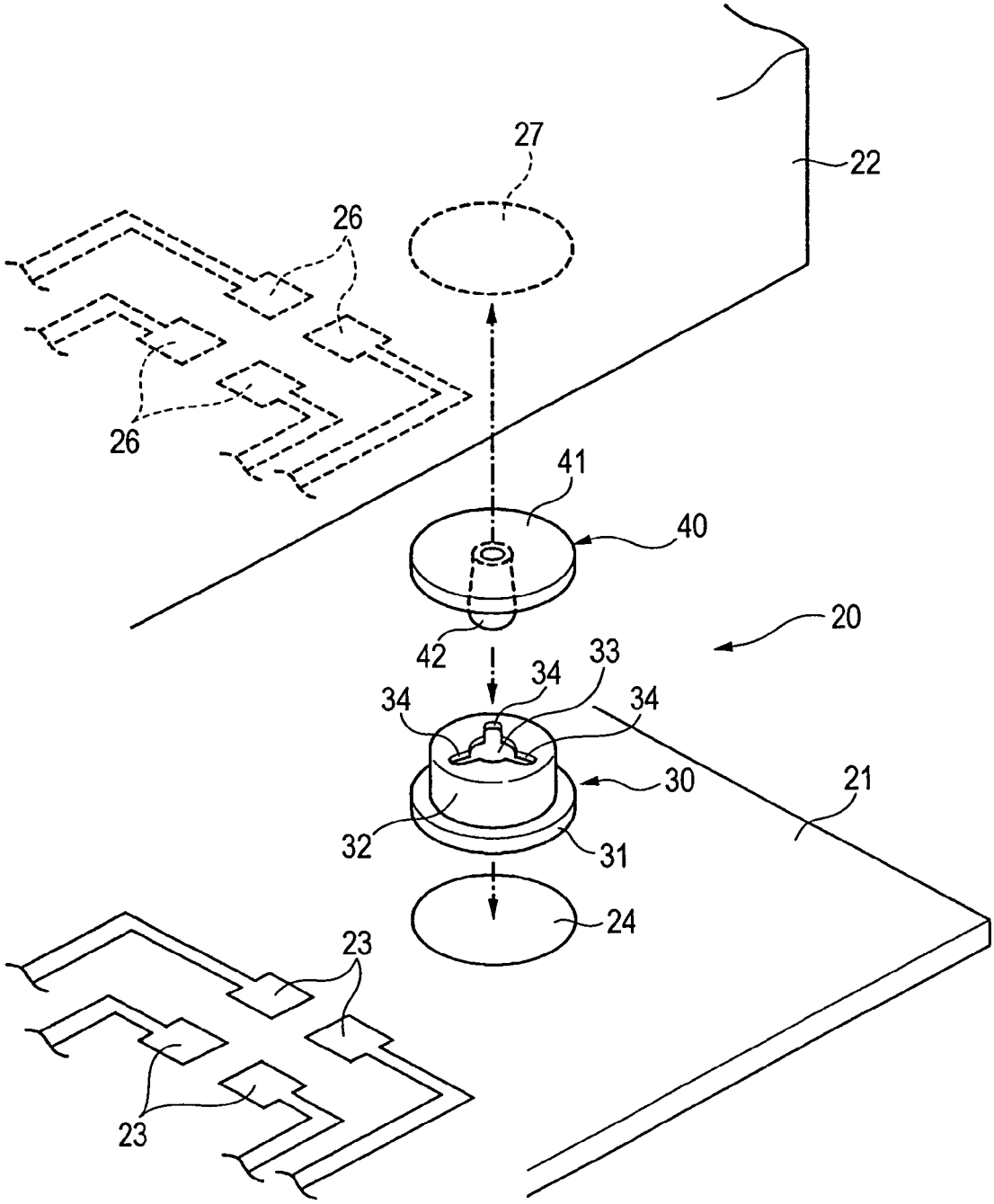
FIG. 5 is a perspective view illustrating a positioning component and a circuit component.

FIG. 5 is an exploded perspective view illustrating the first positioning component 30 and the second positioning component 40 included in a circuit connecting device 20 that uses the connecting element 1 and circuit components that are connected to each other by the connecting element 1. In FIG. 5, the connecting element 1 is not shown. FIG. 6 is a partial sectional view illustrating the state in which the circuit connecting device 20 is assembled.

One of the circuit components that are connected to each other by the connecting element 1 is a motherboard (circuit board) 21, and the other circuit component is an electronic component 22, such as an IC package. A plurality of conducting portions (lands) 23 that face the elastic contacts 16 included in the second elastic contact group 13 on the connecting element 1 are provided on a surface of the motherboard 21. In addition, a metal layer 24 used for positioning is formed on the surface of the motherboard 21. The conducting portions 23 and the metal layer 24 are made of conductive metal, such as copper foil. In addition, the conducting portions 23 and the metal layer 24 are formed in the same process. This process is performed by either a method of etching a metal film, such as a copper foil, formed uniformly over the surface of the motherboard 21 or a method of printing a metal film on the surface of the motherboard 21. The number of conducting portions 23 is the same as the number of elastic contacts 16 included in the second elastic contact group 13 on the connecting element 1, and the metal layer 24 is provided for each of the pair of respective positioning holes 7 in the connecting element 1.

Since the conducting portions 23 and the metal layer 24 are formed in the same process, the relative positions between the conducting portions 23 and the metal layer 24 can be determined with high accuracy within the tolerance range of the above-mentioned process.

A plurality of conducting portions (lands) 26 that face the elastic contacts 15 included in the first elastic contact group 12 on the connecting element 1 and a metal layer 27 used for positioning are provided on a surface of the electronic component 22 that faces the motherboard 21. The conducting portions 26 and the metal layer 27 are also formed in the same process, so that the relative positions therebetween can be determined with high accuracy. The number of conducting portions 26 is the same as the number of elastic contacts 15 included in the first elastic contact group 12 on the connecting element 1, and the metal layer 27 is provided for each of the pair of positioning holes 7 in the connecting element 1.

As shown in FIGS. 5 and 6, the first positioning component 30 is fixed to the metal layer 24 on the motherboard 21, which is one of the circuit components, by soldering (i.e., by adhesion force generated by molten metal). The first positioning component 30 is made of a solderable metal material, such as phosphor bronze, that can be easily deformed elastically and is hollow, as shown in FIG. 6.

The first positioning component 30 has an annular fixing base 31, and the diameter of the outer periphery of the fixing base 31 is substantially equal to the diameter of the metal layer 24 formed in a circular pattern. A cylindrical positioning portion 32 is provided on the fixing base 31. The outer diameter of the positioning portion 32 is substantially equal to or slightly smaller than the inner diameter of each positioning hole 7 formed in the connecting element 1. When the outer diameter of the positioning portion 32 is smaller than the inner diameter of each positioning hole 7, the diameter difference δ1 (see FIG. 6) is set within a tolerance range such that the elastic contacts 15 can face the respective conducting portions 26 and the elastic contacts 16 can face the respective conducting portions 23.

The first positioning component 30 has a circular fitting hole 33 in a top end face thereof. In addition, in the top end face, three cutout portions 34 extend continuously from the circular fitting hole 33 in the radial direction. Since the cutout portions 34 are formed, peripheral portions around the fitting hole 33 can be elastically deformed in the vertical direction. The center of curvature of the fitting hole 33 coincides with the center of curvature of the fixing base 31.

The second positioning component 40 is fixed to the metal layer 27 on the electronic component 22, which is the other circuit component, by soldering (i.e., by adhesion force generated by molten metal). The second positioning component 40 is made of a solderable metal material, such as phosphor bronze, that can be easily deformed elastically. The cross-sectional shape of the second positioning component 40 is shown in FIG. 6.

The second positioning component 40 has a disc-shaped fixing base 41 having a hole at the center, and the diameter of the outer periphery of the fixing base 41 is substantially equal to the diameter of the metal layer 27 formed in a circular pattern. A fitting projection 42 is formed integrally with the fixing base 41 so as to project downward at the center of the fixing base 41. The axial center of the fitting projection 42 coincides with the center of curvature of the fixing base 41. The fitting projection 42 has a substantially spherical surface at an end thereof, and the outer diameter of the fitting projection 42 is slightly larger than the inner diameter of the circular fitting hole 33 formed in the first positioning component 30. When the fitting projection 42 is forcibly inserted into the circular fitting hole 33 in the first positioning component 30, the first positioning component 30 and the second positioning component 40 are assembled coaxially with each other without causing an axial displacement.

Next, the assembly process of the circuit connecting device 20 will be described below.

Solder paste for reflow soldering is applied to the metal layer 24 on the motherboard 21, and the first positioning component 30 is mounted on the metal layer 24 by an automatic mounting device having a mounting suction head for holding the first positioning component 30 by suction. Then, a heating process is performed in which the solder paste melts and the first positioning component 30 is fixed to the metal layer 24. The automatic mounting device determines the attachment position of the first positioning component 30 by performing coordinate indexing using a positioning mark formed on the motherboard 21 as a reference. Thus, the first positioning component 30 is accurately positioned and fixed on the surface of the motherboard 21.

If the first positioning component 30 placed on the metal layer 24 on which the solder paste is applied is displaced, a self alignment function for causing the axial center of the first positioning component 30 to coincide with the center of the metal layer 24 with high accuracy is obtained due to the surface tension of the molten solder while the solder paste is in a molten state in the heating process.

Similarly, the second positioning component 40 is soldered on the metal layer 27 by an automatic mounting process and a reflow soldering process. Also in this case, due to the positioning accuracy of the automatic mounting device and the surface tension of the molten solder, the second positioning component 40 is soldered on the metal layer 27 such that the axial center of the second positioning component 40 coincides with the center of the metal layer 27 with high accuracy.

As shown in FIG. 6, the connecting element 1 is placed on the surface of the motherboard 21. In this state, the positioning portion 32 of each of a pair of first positioning components 30 fixed on the motherboard 21 is inserted into the corresponding positioning hole 7 in the connecting element 1 so that the connecting element 1 is positioned with respect to the motherboard 21. As described above, in the motherboard 21, the relative positions between the conducting portions 23 and the metal layer 24 are determined with high accuracy, and accordingly the relative positions between the conducting portions 23 and the first positioning component 30 are determined with high accuracy. In addition, in the connecting element 1, the relative positions between the elastic contacts 16 included in the second elastic contact group 13 and the centerline O1 of each positioning hole 7 are determined with high accuracy. Accordingly, even when the size of each elastic contact 16 is small and the density of the elastic contacts 16 is high, the elastic contacts 16 can be brought into contact with the respective conducting portions 23 in one-to-one correspondence.

Next, the electronic component 22 is mounted on the motherboard 21. In this state, the fitting projection 42 of each of a pair of second positioning components 40 fixed to the electronic component 22 is fitted into the fitting hole 33 formed in the corresponding first positioning component 30. Since the fitting projection 42 is tightly fitted into the fitting hole 33 without a gap therebetween, the center of the metal layer 24 on the motherboard 21 and the center of the metal layer 27 on the electronic component 22 are aligned with each other on the same axis.

In the electronic component 22, the relative positions between the conducting portions 26 and the metal layer 27 are determined high accuracy. In addition, in the connecting element 1, the relative positions between the elastic contacts 15 included in the first elastic contact group 12 and the centerline O1 of each positioning hole 7 are determined with high accuracy. Therefore, when the first positioning component 30 and the second positioning component 40 are engaged with each other, the elastic contacts 15 included in the first elastic contact group 12 of the connecting element 1 reliably face the respective conducting portions 26 on the electronic component 22.

Referring to FIG. 6, the electronic component 22 is pressed toward the motherboard 21 while the motherboard 21 and the electronic component 22 face each other with the connecting element 1 provided therebetween. Accordingly, the elastic contacts 16 are elastically deformed and are reliably connected to the respective conducting portions 23 on the motherboard 21 and the elastic contacts 15 are elastically deformed and are reliably connected to the conducting portions 26 on the electronic component 22. In the state in which the elastic contacts 15 and the elastic contacts 16 are elastically deformed, the electronic component 22 and the motherboard 21 are fixed to each other by means of pressure fixing, screws, adhesion, etc. (not shown).

Referring to FIG. 6, when the electronic component 22 is pressed toward the motherboard 21 such that the elastic contacts 15 and the elastic contacts 16 are elastically deformed to a maximum and a sufficient elastic pressing force is applied to the conducting portions 23 and the conducting portions 26, a small gap $\delta 2$ is provided between the top face 4*a* of each mounting portion 4 of the connecting element 1 and the fixing base 41 of the corresponding second positioning component 40. Accordingly, sufficient areas for elastic deformation are provided for the elastic contacts 15 and the elastic contacts 16 when the first positioning component 30 and the second positioning component 40 are fitted to each other such that the gap δ2 is provided.

Figure 7:
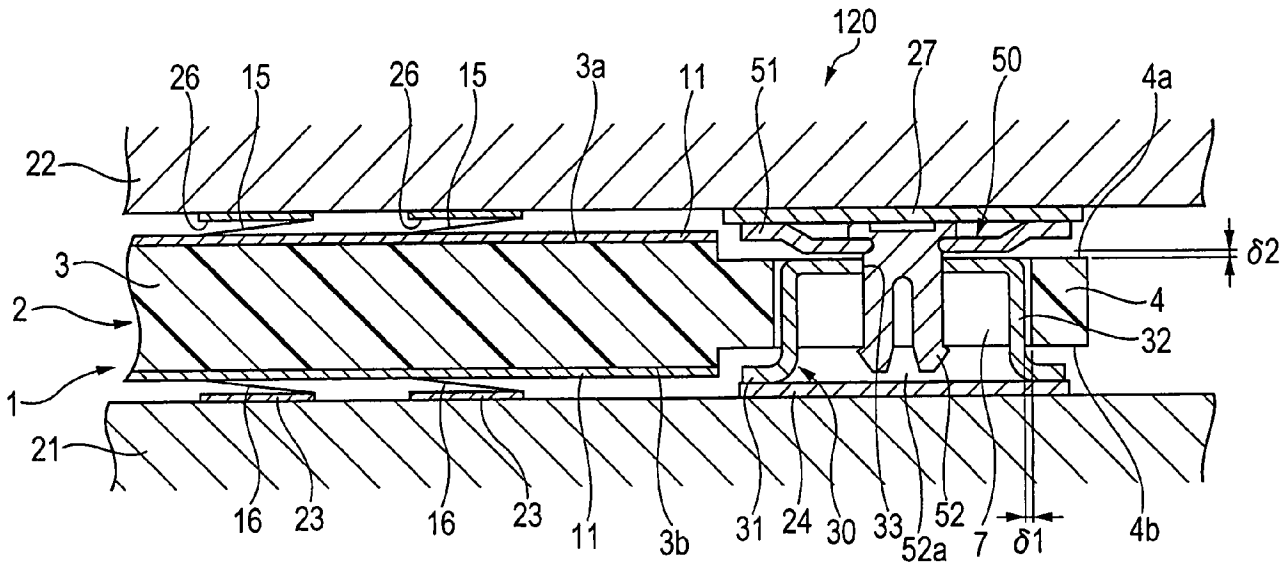
FIG. 7 is a sectional view of a circuit connecting device according to a second embodiment of the present invention.

FIG. 7 is a sectional view corresponding to FIG. 6, illustrating a portion of a circuit connecting device 120 according to a second embodiment of the present invention.

The circuit connecting device 120 has a second positioning component 50 that is different from the second positioning component 40 according to the first embodiment. The other structure of the circuit connecting device 120 is similar to that of the first embodiment.

The second positioning component 50 used in the circuit connecting device 120 according to the second embodiment includes a circular disc-shaped fixing base 51 made of solderable metal material and a fitting projection 52 made of synthetic resin that is fitted to the disc-shaped fixing base 51 at a central region thereof. The fitting projection 52 has an expanding slot 52*a* that extends from an end of the fitting projection to an intermediate position thereof. A first positioning component 30 has a fitting hole 33 in a top end face thereof. In the second embodiment, it is not necessary that the above-mentioned cutout portions 34 be formed. The outer diameter of the fitting projection 52 of the second positioning component 50 is slightly larger than the inner diameter of the fitting hole 33 formed in the first positioning component 30.

The fixing base 51 of the second positioning component 50 is fixed to a metal layers 27 on an electronic component 22 by reflow soldering. As shown in FIG. 7, since the fitting projection 52 of the second positioning component 50 has the expanding slot 52*a*, the fitting projection 52 can be inserted into the fitting hole 33 formed in the first positioning component 30 while the diameter of the fitting projection 52 is reduced. After the insertion, the fitting projection 52 is tightly fitted to the fitting hole 33 without a gap provided therebetween, so that the first positioning component 30 and the second positioning component 50 are positioned coaxially.

Figure 8:
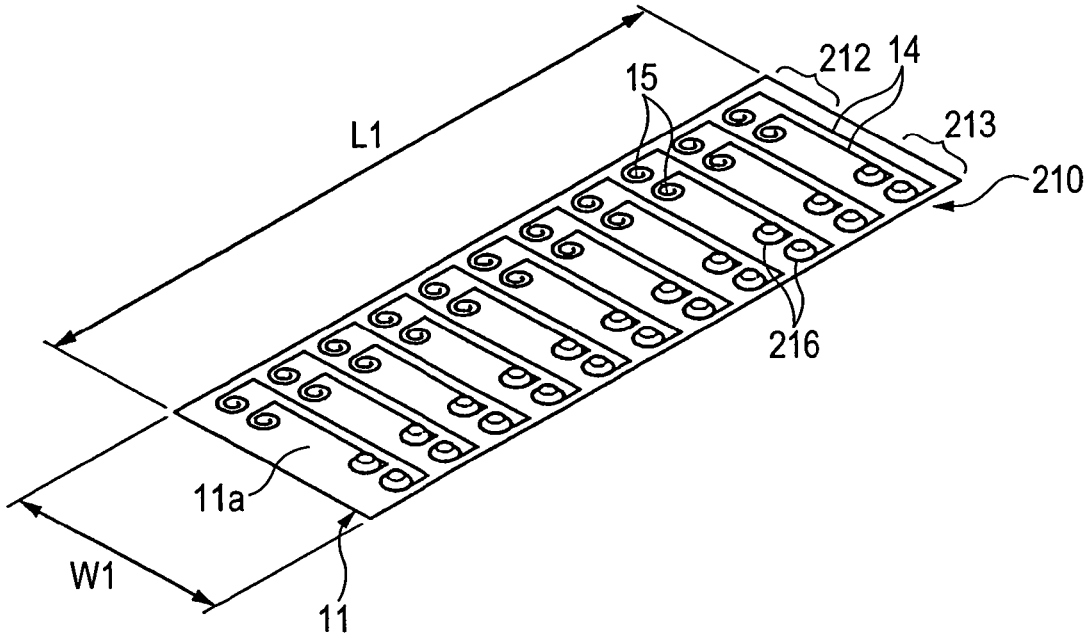
FIG. 8 is a perspective view of a connecting sheet included in a connecting element according to a third embodiment of the present invention.
Figure 9:
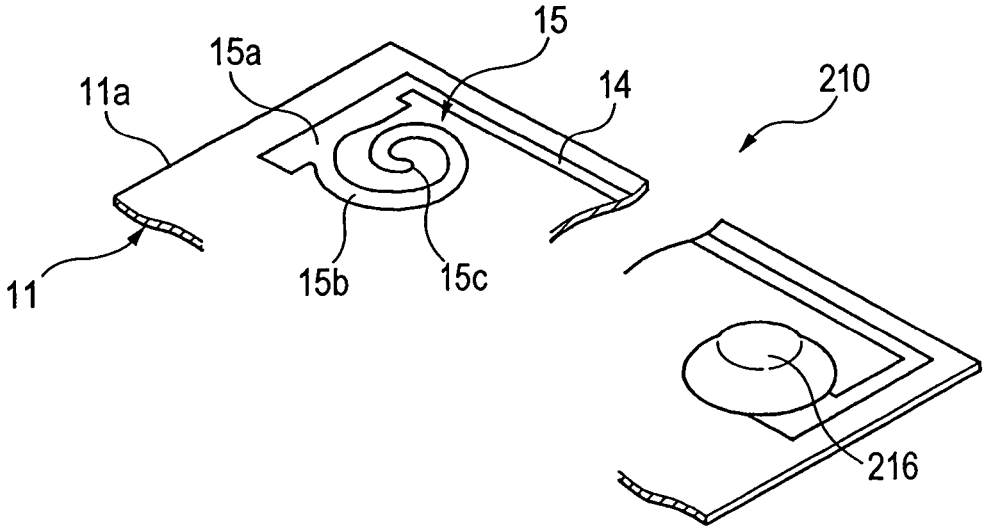
FIG. 9 is an enlarged perspective view illustrating portions of the connecting sheet according to the third embodiment.
Figure 10:
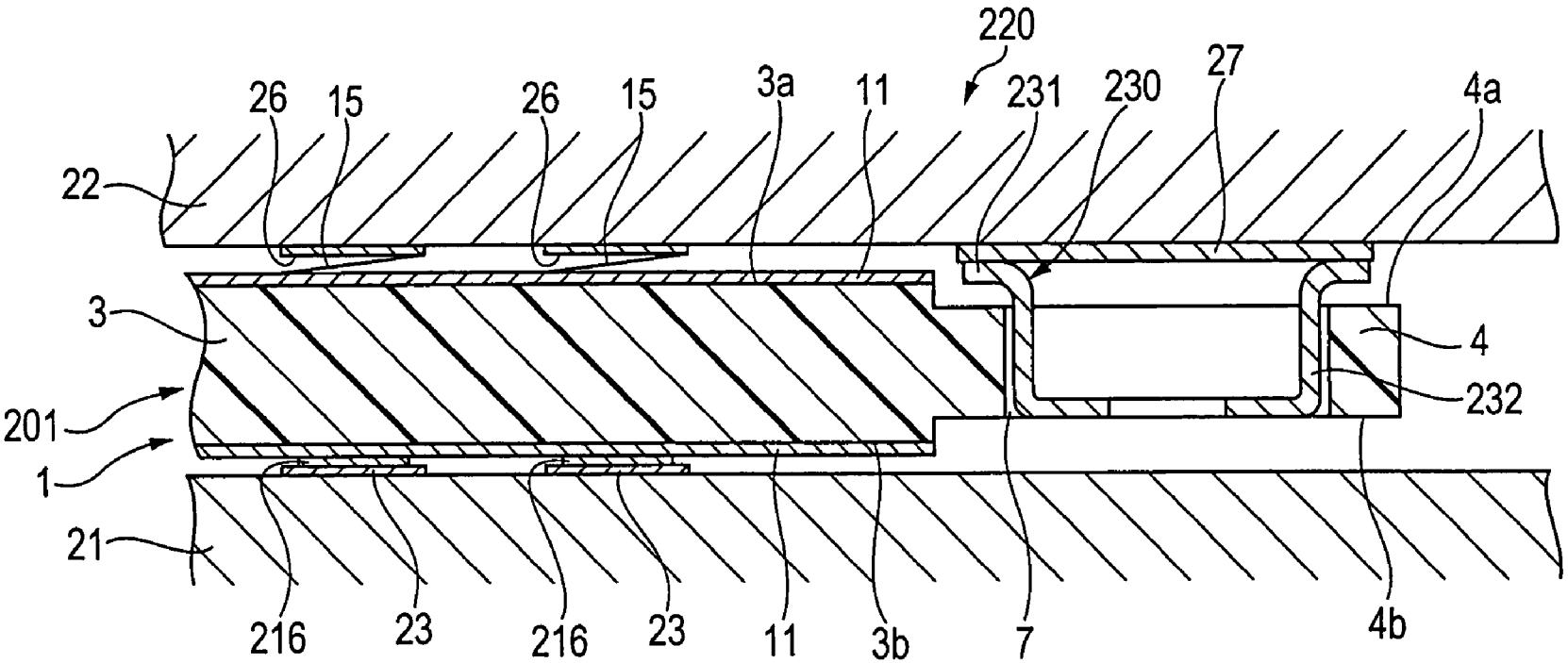
FIG. 10 is a sectional view of a circuit connecting device according to the third embodiment.

FIGS. 8 to 10 illustrate a third embodiment of the present invention. FIG. 8 is a perspective view of a connecting sheet 210 included in a connecting element 201 according to the third embodiment. FIG. 9 is an enlarged perspective view illustrating portions of the connecting sheet 210. FIG. 10 is a sectional view illustrating a portion of a circuit connecting device 220 according to the third embodiment.

Although only a portion of the connecting element 201 is shown in FIG. 10, the connecting element 201 includes a support member 2 having exactly the same structure as the support member 2 shown in FIGS. 1, 2A, and 2B. The connecting sheet 210 attached to the support member 2 has a flexible substrate 11 having the same structure as that included in the connecting sheet 10 shown in FIG. 3. The length and width of the flexible substrate 11 are L1 and W1, respectively. The dimensional relationship between the flexible substrate 11 and the support member 2 is similar to that of the first embodiment shown in FIG. 1.

As shown in FIG. 8, the connecting sheet 210 has an elastic contact group 212 on a surface 11*a* of the flexible substrate 11. The elastic contact group 212 includes a plurality of elastic contacts 15 that are arranged regularly, each elastic contacts 15 having the same structure as the elastic contact 15 shown in FIG. 4 that is provided on the connecting sheet 10. The connecting sheet 210 also has a fixed contact group 213 on the surface 11*a* of the flexible substrate 11, and the fixed contact group 213 includes a plurality of fixed contacts 216 that are arranged regularly. As shown in FIG. 9, each of the fixed contacts 216 is composed of a solder bump, a plated bump, etc., that swells upward, and substantially does not deform elastically.

The elastic contacts 15 are conductively connected to the respective fixed contacts 216 in one-to-one correspondence by a wiring pattern 14.

Similar to the structure shown in FIG. 1, the connecting sheet 210 is fixed to the support member 2 in the connecting element 201. More specifically, the connecting sheet 210 is wrapped around and fixed to the support member 2 such that the elastic contact group 212 is positioned on a first opposing face 3*a* of a substrate-holding portion 3 of the support member 2 and the fixed contact group 213 is positioned on a second opposing face 3*b* of the substrate-holding portion 3. The structure for positioning the connecting sheet 210 with respect to the support member 2 is similar to that in the connecting element 1 according to the first embodiment.

In the connecting element 201, the fixed contacts 216 that are conductively connected to the respective elastic contacts 15 that are positioned directly under the elastic contacts 15 on the first opposing face 3*a*.

As shown in FIG. 10, in the circuit connecting device 220 according to the third embodiment, the motherboard 21 has a plurality of conducting portions 23 that correspond to the fixed contacts 216 included in the fixed contact group 213. The connecting element 201 is positioned such that the fixed contacts 216 face the respective conducting portions 23, and the fixed contacts 216 are fixed to the respective conducting portions 23 by soldering. At this time, the connecting element 201 is positioned with respect to the motherboard 21 by automatically mounting the connecting element 201 on the motherboard 21 using an automatic mounting device and soldering the fixed contacts 216 on the respective conducting portions 23 in a reflow soldering process. Alternatively, the connecting element 201 may also be positioned and soldered on the motherboard 21 using a jig.

Similar to the structure shown in FIG. 5, an electronic component 22 has a plurality of conducting portions 26 and a circular metal layer 27 formed in the same process. A positioning component 230 is automatically mounted on the metal layer 27 by an automatic mounting device, and is positioned and fixed to the metal layer 27 by soldering.

The positioning component 230 has the same structure as the first positioning component 30 shown in FIG. 5, or is structured similarly to the first positioning component 30 except the fitting hole 33 and the cutout portions 34 are not formed.

When the electronic component 22 is mounted on the motherboard 21, the positioning component 230 fixed to the electronic component 22 is inserted into a positioning hole 7 formed in the connecting element 201 fixed to the motherboard 21. Accordingly, the elastic contacts 15 on the connecting element 201 face the respective conducting portions 26 on the electronic component 22 in one-to-one correspondence. Therefore, when the electronic component 22 is pressed toward the motherboard 21 and fixed, the elastic contacts 15 provided on the first opposing face 3*a* of the connecting element 201 come into contact with the respective conducting portions 26 in a compressed state.

Next, a preferred fixing structure for accurately positioning and soldering the first positioning component 30 shown in FIGS. 5 to 7 on the motherboard 21 will be described below.

Figure 11A:
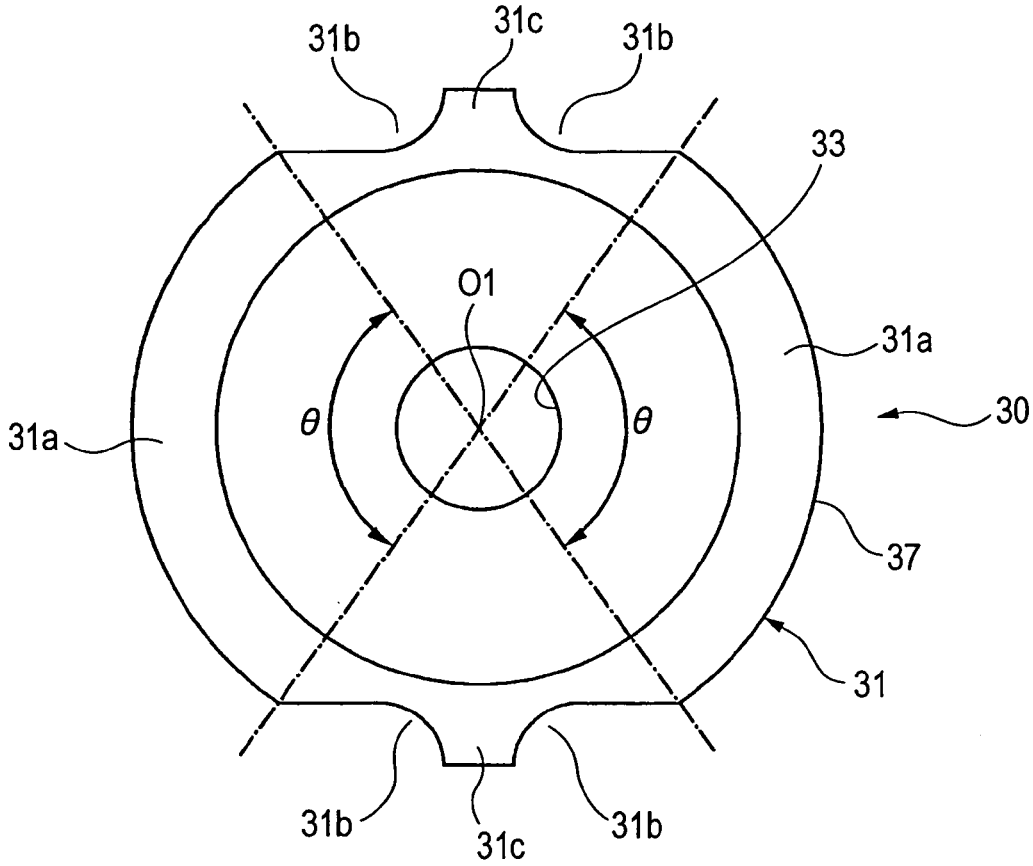
FIGS. 11A and 11B are an enlarged plan view and an enlarged side view, respectively, of a first positioning component.
Figure 11B:
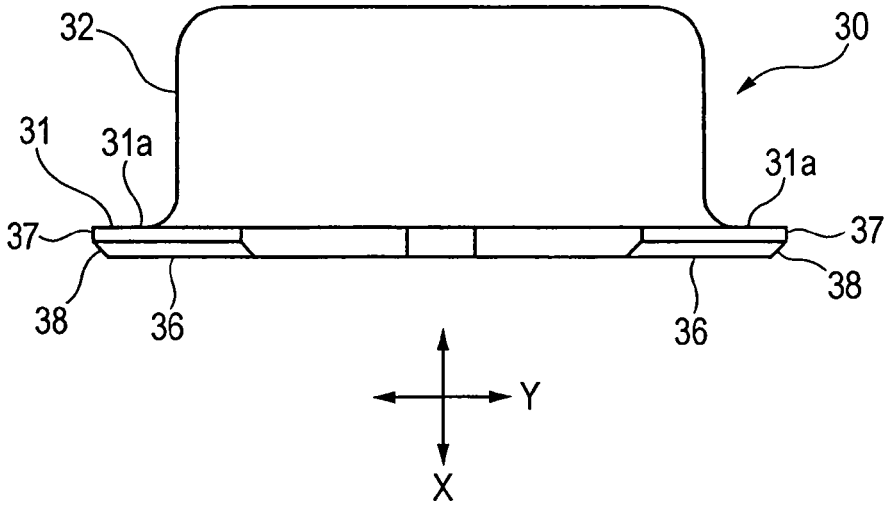
Figure 12A:
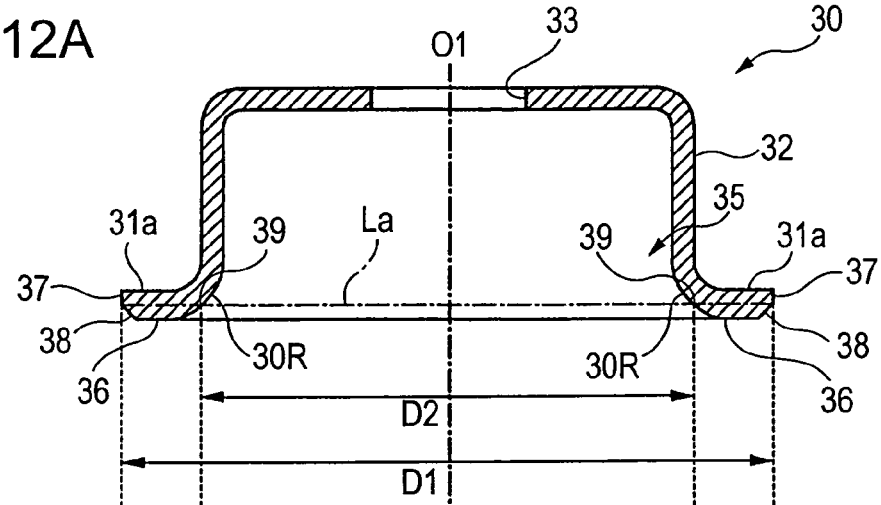
FIGS. 12A and 12B are a sectional view of the first positioning component and a plan view of a metal layer, respectively.
Figure 12B:
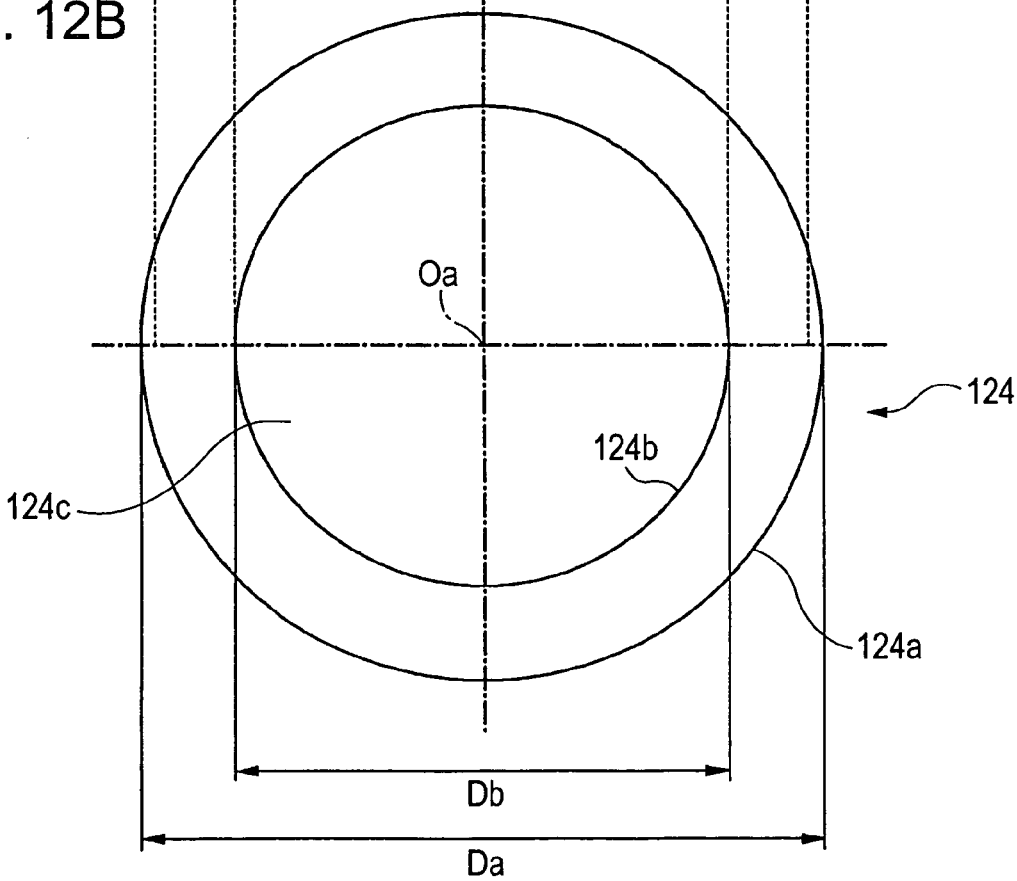
Figure 13:
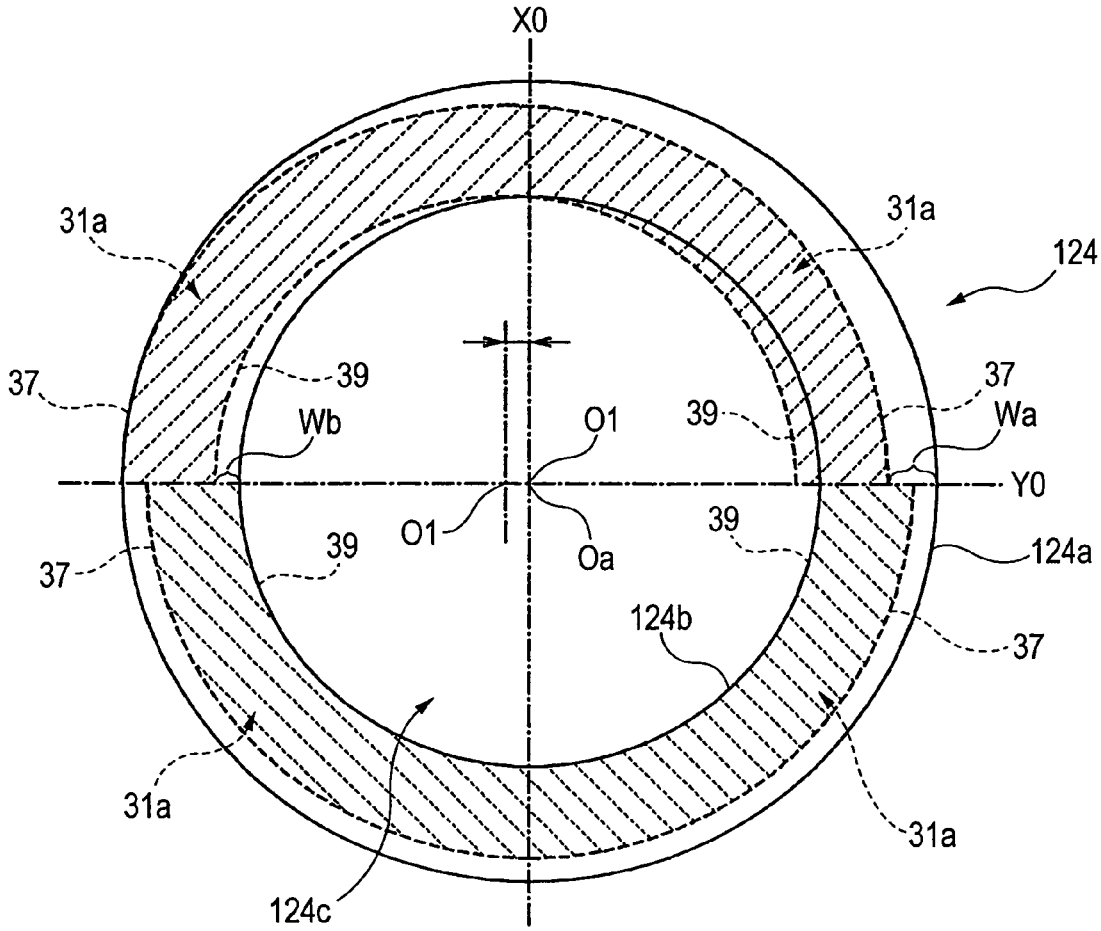
FIG. 13 is a plan view illustrating a self alignment function of the first positioning component with respect to the metal layer.
Figure 14A:
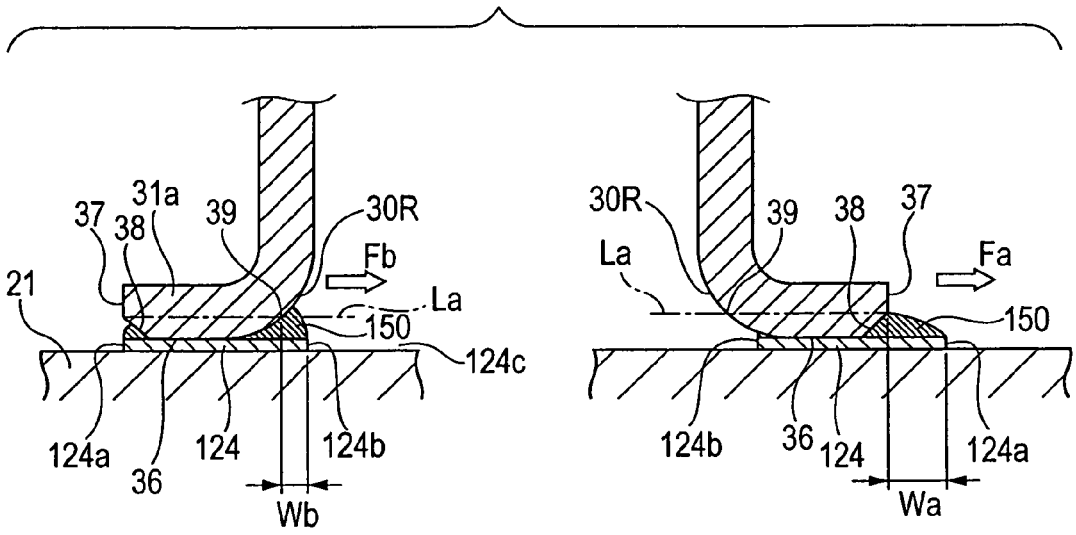
FIGS. 14A and 14B are enlarged sectional views of a connecting portion between a fixed base of the first positioning component and the metal layer, where
Figure 14B:
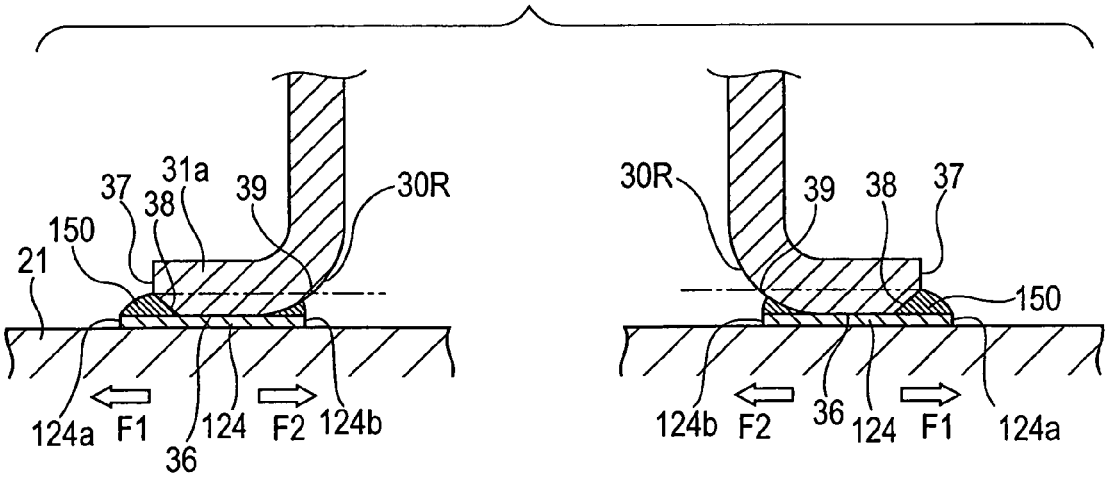

FIGS. 11A and 11B are an enlarged plan view and an enlarged side view, respectively, of the first positioning component 30. FIG. 12A is a sectional view of the first positioning component 30, and FIG. 12B is a plan view of a metal layer 124 formed on the surface of the motherboard 21. The metal layer 124 is formed on the surface of the motherboard 21 in place of the metal layer 24 shown in FIGS. 5 to 7. FIG. 13 is a plan view illustrating a self alignment function obtained when the first positioning component 30 is mounted at a position displaced with respect to the metal layer 124. FIGS. 14A and 14B are enlarged sectional views illustrating soldered portions between the first positioning component 30 and metal layer 124 for explaining the self alignment function.

As described in the first embodiment, the first positioning component 30 shown in FIGS. 11A, 11B, and 12A is composed of a leaf spring material, such as phosphor bronze, with a thickness of about 0.03 mm to 0.3 mm. In the present embodiment, the thickness is 0.1 mm. The first positioning component 30 includes a fixing base 31 and a cylindrical positioning portion 32 having a hollow inner space 35, and a fitting hole 33 is formed in a top face of the positioning portion 32. The first positioning component 30 shown in FIGS. 11A, 11B, and 12A do not have the cutout portions 34 shown in FIG. 5.

Referring to FIG. 11A, with regard to the planar shape of the fixing base 31, arc-shaped portions 31*a* are formed on the left and right so as to face each other across the inner space 35. The arc-shaped portions 31*a* are formed over a certain width along a circle centered on the centerline O1. The left and right arc-shaped portions 31*a* have an angular range θ of 90° to 180° around the centerline O1. In the present embodiment, the angular range θ is set to 120°.

The fixing base 31 has four cutout portions 31*b* that concave toward the center from the outer periphery of the fixing base 31 in areas outside the arc-shaped portions 31*a* and projecting portions 31*c* positioned between the cutout portions 31*b*. When the first positioning component 30 is soldered on the metal layer 124, a large self-alignment force is generated in a direction in which the arc-shaped portions 31*a* face each other. Therefore, the first positioning component 30 is preferably mounted on the motherboard 21 such that the direction in which the arc-shaped portions 31*a* face each other coincides with the longitudinal direction of the connecting element 1 shown in FIG. 1, that is, in the Y direction. However, the first positioning component 30 may also be mounted such that the direction in which the arc-shaped portions 31*a* face each other coincides with the X direction. Alternatively, since the first positioning component 30 is inserted into each of the pair of positioning holes 7 formed in the connecting element 1, one of the first positioning components 30 inserted in the positioning holes 7 may be mounted such that the direction in which the arc-shaped portions 31*a* face each other coincides with the Y direction, while the other first positioning component 30 is mounted such that the direction in which the arc-shaped portions 31*a* face each other coincides with the X direction.

FIG. 12A and FIGS. 14A and 14B show detailed structure of the arc-shaped portions 31*a* of the fixing base 31. The arc-shaped portions 31*a* have a planar mounting face 36 at the bottom and a chamfered portion 38 that is formed between an outer peripheral edge 37 and the mounting face 36 and that extends over the entire length of the arc-shaped portions 31*a*. The volume of a portion removed for forming the chamfered portion 38 is small, and the dimension of the chamfered portion 38 is "C 0.005", which means that the removed portion is 0.05 mm (50 μm) from the outer peripheral edge 37 toward the centerline O1 and 0.05 mm (50 μm) from the mounting face 36 in the height direction in the sectional view.

A curved portion 30R having a relatively large radius that curves toward the inner periphery of the positioning portion 32 is formed along the inner surfaces of the arc-shaped portions 31*a*. In the present embodiment, an intersecting portion between an imaginary horizontal line La that passes through boundary points between the outer peripheral edge 37 and the chamfered portion 38 and the curved portion 30R is defined as an inner peripheral edge 39 of the arc-shaped portions 31*a*. In the case in which the volume of the portion removed for forming the chamfered portion 38 is large, that is, when the dimension C of the chamfered portion 38 is larger than 0.05, the boundary between the mounting face 36 and the chamfered portion 38 is regarded as the outer periphery of the arc-shaped portions 31*a*.

The first positioning portion 30 has a diameter D1 of 5 mm or less at the outer peripheral edge 37 and the weight thereof is 1 g or less. Preferably, the diameter D1 is 3 mm or less and the weight is 0.5 g or less. In the present embodiment, the diameter D1 of the outer peripheral edge 37 is 2.0 mm and the diameter of the inner peripheral edge 39 is 1.5 mm. Therefore, the distance between the outer peripheral edge 37 and the inner peripheral edge 39 is 0.25 mm.

As described above, the pattern of the metal layer 124 on the surface of the motherboard 21 is formed together with the conducting portions 23 shown in FIG. 5 in the same process, and the planar shape of the metal layer 124 is circular. The bottom faces of the arc-shaped portions 31*a* of the fixing base 31 included in the first positioning component 30 are formed such that the bottom faces can come into surface contact with the surface of the metal layer 124.

An outer peripheral edge 124*a* and an inner peripheral edge 124*b* of the metal layer 124 are concentric circles centered on a center point Oa. A diameter Da of the outer peripheral edge 124*a* is equal to or larger than the diameter D1 of the outer peripheral edge 37 of the arc-shaped portions 31*a* of the first positioning component 30. When the diameter Da is larger than the diameter D1, the difference between the diameter Da and the diameter D1 is preferably 0.3 mm or less. More preferably, the difference is in the range of 0.05 mm to 0.15 mm. In the present embodiment, the difference between the diameter Da and the diameter D1 is 0.1 mm. Accordingly, when the centerline O1 of the first positioning component 30 coincides with the center Oa of the metal layer 124, the outer peripheral edge 124*a* of the metal layer 124 protrudes from the outer peripheral edge 37 of the first positioning component 30 by 0.05 mm (50 μm).

The diameter Db of the inner peripheral edge 124*b* of the metal layer 124 is equal to or less than the diameter D2 of the inner peripheral edge 39 of the arc-shaped portions 31*a* of the first positioning component 30. When the diameter Db is less than the diameter D2, the difference between the diameter Db and the diameter D2 is preferably 0.3 mm or less. More preferably, the difference is in the range of 0.05 mm to 0.15 mm. In the present embodiment, the diameter D2 is equal to the diameter Db.

The metal layer 124 has an annular shape and a hollow area 124*c* is provided at the center. The arc-shaped portions 31*a* of the first positioning component 30 are soldered on the annular metal layer 124 having a predetermined width such that the arc-shaped portions 31*a* come into surface contact with the metal layer 124. Therefore, a self alignment function for causing the centerline O1 of the first positioning component 30 to coincide with the center Oa of the metal layer 124 is effectively obtained due to the surface tension of the molten solder. For this purpose, at least one of the following two conditions is preferably satisfied: a) the diameter Da of the outer peripheral edge 124*a* of the metal layer 124 is larger than the diameter D1 of the outer peripheral edge 37 of the first positioning component 30, and b) the diameter Db of the inner peripheral edge 124*b* of the metal layer 124 is smaller than the diameter D2 of the inner peripheral edge 39 of the first positioning component 30. When the diameter Da of the outer peripheral edge 124*a* is larger than the diameter D1 of the outer peripheral edge 37, the diameter Db of the inner peripheral edge 124*b* may be slightly larger than the diameter D2 of the inner peripheral edge 39.

The above-described alignment function will be described in more detail below.

When the first positioning component 30 is mounted on the motherboard 21, first, solder paste for reflow soldering is applied to the surface of the annular metal layer 124, and the first positioning component 30 is mounted on the metal layer 124 by an automatic mounting device having a mounting suction head for holding the first positioning component 30 by suction. The solder paste melts in the heating process, and is then cooled to solidify the solder. In FIGS. 14A and 14B, the molten solder in the heating process is denoted by reference numeral 150.

In FIG. 13, orthogonal axes that pass through the center Oa of the metal layer 124 are shown by Y0 and X0. In FIG. 13, the upper half above the axis Y0 shows the state in which the first positioning component 30 is mounted at a position displaced leftward in the figure, and the lower half below the axis Y0 shows the state in which positioning is completed and the centerline O1 of the first positioning component 30 coincides with the center Oa of the metal layer 124. For convenience of explanation, in FIG. 13, the arc-shaped portions 31*a* of the fixing base 31 included in the first positioning component 30 are shown as an integral annular portion 31*a* that extends along the entire circumference. FIG. 14A shows the state in which the first positioning component 30 is mounted at a position displaced leftward in the figure, and FIG. 14B shows the state in which positioning is completed and the centerline O1 of the first positioning component 30 coincides with the center Oa of the metal layer 124.

As shown in the upper half of FIG. 13 and FIG. 14A, when the first positioning component 30 is displaced leftward in the figures, a solder fillet portion with a maximum width Wa is provided between the outer peripheral edge 124*a* of the metal layer 124 and the outer peripheral edge 37 of the annular portion 31*a* on the right side of the figures. In addition, a solder fillet portion with a maximum width Wb is provided between the inner peripheral edge 124*b* of the metal layer 124 and the inner peripheral edge 39 of the annular portion 31*a* on the left side of the figures.

When a common mounting device is used, a maximum displacement that occurs when the first positioning component 30 is mounted on the motherboard 21 is about 0.05 mm (50 μm). Accordingly, in the present embodiment, if the first positioning component 30 is mounted at a position displaced by a maximum distance, the width Wa of the solder fillet portion on the right is 0.1 mm and the inner peripheral edge 39 of the annular portion 31*a* is positioned closer to the center than the inner peripheral edge 124*b* of the metal layer 124 on the right side. In addition, the width Wb of the solder fillet portion on the left is 0.05 mm, and the outer peripheral edge 37 of the annular portion 31*a* substantially coincides with the outer peripheral edge 124*a* of the metal layer 124 on the left side.

Accordingly, as shown in FIG. 14A, a force Fa that tries to move the first positioning component 30 rightward is generated due to the surface tension of the molten solder 150 in the solder fillet portion on the right, and a force Fb that also tries to move the first positioning component 30 rightward is generated due to the surface tension of the molten solder 150 in the solder fillet portion on the left. Due to the above-mentioned forces Fa and Fb, the first positioning component 30 is moved rightward. Then, when the centerline O1 of the first positioning component 30 coincides with or substantially coincides with the center Oa of the metal layer 124, as shown in FIG. 14B, an outward surface tension F1 applied to the outer peripheral edge 37 of the annular portion 31*a* and an inward surface tension F2 applied to the inner peripheral edge 39 balance each other. In this balanced state, the molten solder 150 is cooled and solidified. Accordingly, the first positioning component 30 is fixed such that first positioning component 30 is positioned with respect to the center Oa of the metal layer 124.

The above-described high-accuracy self-alignment function is provided since the hollow area 124*c* is formed in the metal layer 124 and portions of the metal layer 124 having a predetermined width that face each other across the hollow area 124*c* come into surface contact with the annular portion 31*a* of the first positioning component 30 having a predetermined width. If, for example, a circular metal layer 124 that does not have a hollow area is used as shown in FIG. 5 and the first positioning component 30 is mounted at a displaced position as shown in FIG. 14A, a large solder fillet portion is formed between the arc-shaped portions 31*a* at the left and right. Therefore, the surface tension of this portion is larger than the force Fa generated at the right, and the force Fb at the left cannot be generated. As a result, when the annular metal layer 124 having the hollow area 124*c* at the center is used, the accuracy of the self alignment function can be increased compared to the case in which the circular metal layer 24 shown in FIG. 5 is used.

Figure 15:
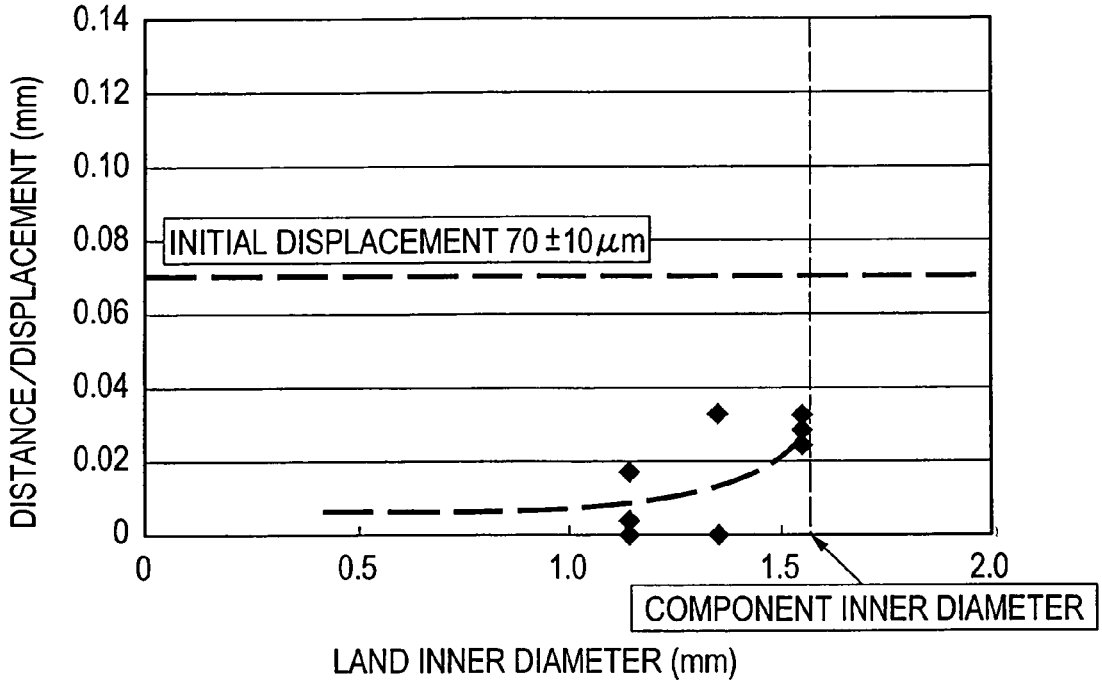
FIG. 15 is a graph illustrating a self alignment function obtained when the first positioning component is soldered.
Figure 16:
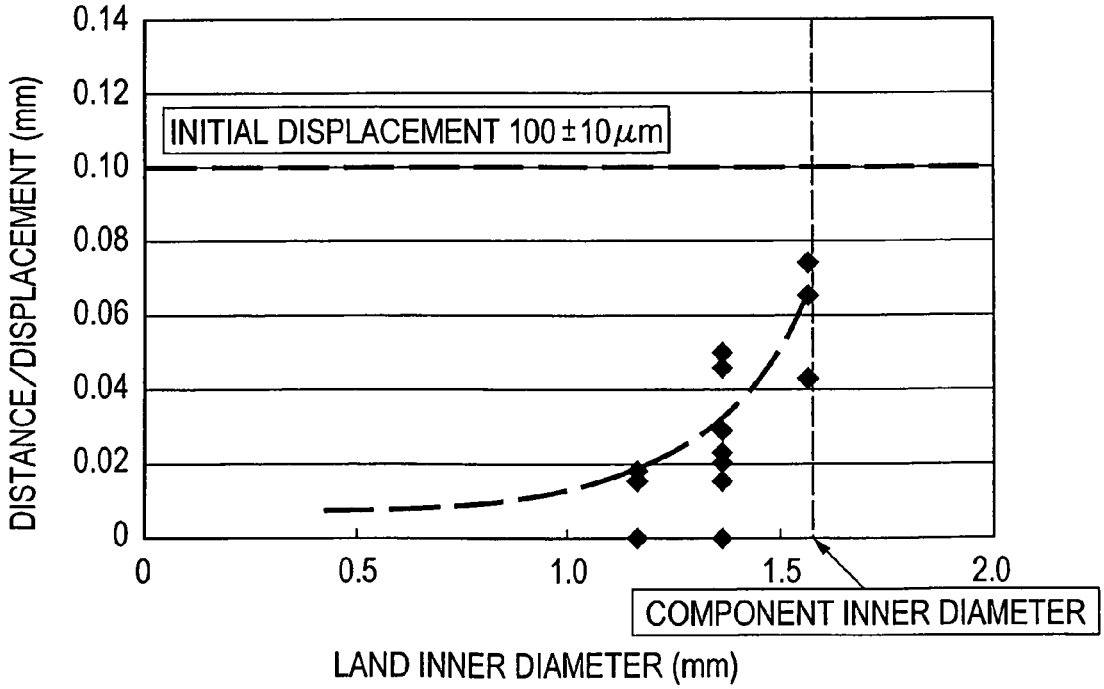
FIG. 16 is another graph illustrating a self alignment function obtained when the first positioning component is soldered.
Figure 17:
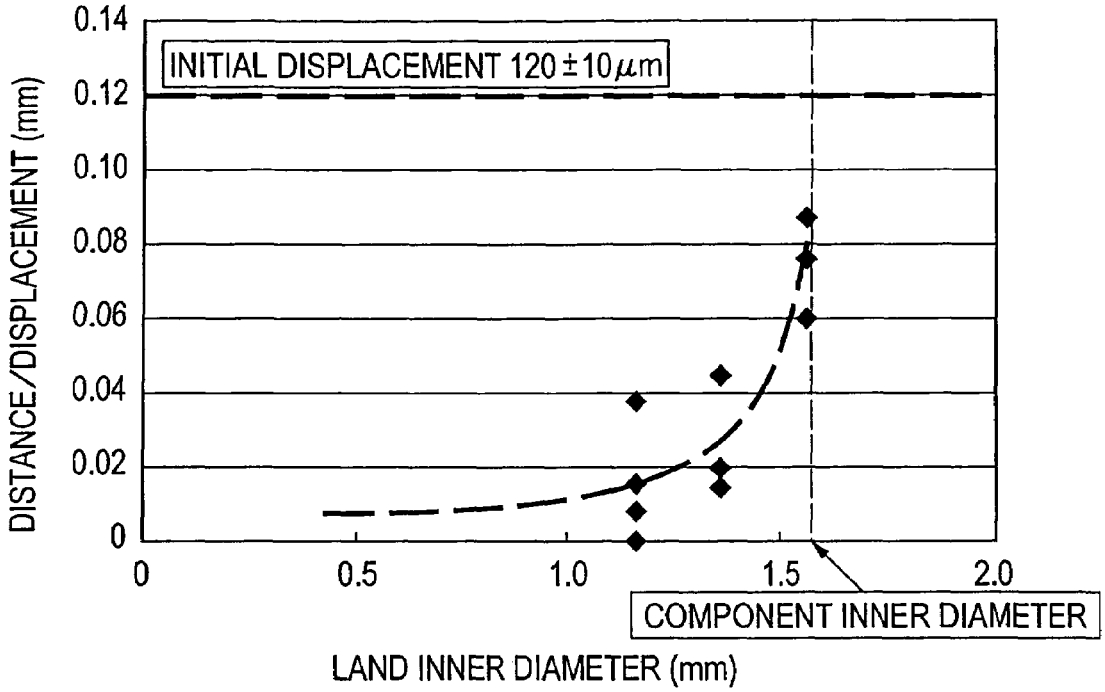
FIG. 17 is another graph illustrating a self alignment function obtained when the first positioning component is soldered.

FIGS. 15, 16, and 17 are graphs showing the result of measurement of the relationship between the diameter of the inner peripheral edge 124*b* of the annular metal layer 124 and the self alignment function.

In the first positioning component 30 used for the measurement, the diameter of the outer peripheral edge 37 is set to 2.0 mm and the diameter of the inner peripheral edge 39 is set to 1.5 mm, as described above. In addition, in the metal layer 124, the diameter of the outer peripheral edge 124*a* is set to 2.1 mm, and the diameter of the inner peripheral edge 124*b* is varied. In FIGS. 15 to 17, the horizontal axis shows the diameter of the inner peripheral edge 124*b* and the vertical axis shows the distance (amount of alignment) by which the centerline O1 of the first positioning component 30 is moved after the first positioning component 30 is mounted at a displaced position and before the solder is solidified. FIG. 15 shows the measurement result obtained when the first positioning component 30 is mounted at a position where the centerline O1 of the first positioning component 30 is displaced from the center Oa of the metal layer 124 by 0.07 mm (70 μm). FIG. 16 shows the measurement result obtained when the displacement of the centerline O1 is set to 0.1 mm (100 μm), and FIG. 17 shows the measurement result obtained when the displacement of the centerline O1 is set to 0.12 mm (120 μm).

It is understood from the measurement result shown in FIGS. 15 to 17 that, in either case, the self alignment function can be obtained when the difference between the diameter D2 of the inner peripheral edge 39 of the first positioning component 30 and the diameter Db of the inner peripheral edge 124*b* of the metal layer 124 is 0.3 mm or less. In addition, when the diameter difference is 0.2 mm or less, the self alignment function is improved. When the diameter difference is 0, that is, when the diameter D2 is equal to the diameter Db, the alignment function is further improved. In addition, it is understood that alignment function can be obtained even when the displacement of the first positioning component 30 is increased to about 0.12 mm.

As is clear from above, the diameter Db of the inner peripheral edge 124*b* of the metal layer 124 is preferably equal to or smaller than the diameter D2 of the inner peripheral edge 39 of the arc-shaped portions 31*a* of the first positioning component 30. In addition, when the diameter Db is smaller than the diameter D2, the difference between the diameter Db and the diameter D2 is preferably 0.3 mm or less. More preferably, the diameter difference is in the range of 0.05 mm to 0.15 mm.

In addition, the diameter Da of the outer peripheral edge 124*a* is preferably equal to or larger than the diameter D1 of the outer peripheral edge 37 of the arc-shaped portions 31*a* of the first positioning component 30. When the diameter Da is larger than the diameter D1, the difference between the diameter Da and the diameter D1 is preferably 0.3 mm or less. More preferably, the diameter difference is in the range of 0.05 mm to 0.15 mm.

Although the first positioning component 30 is described above, the above-described structure may also be applied to the second positioning component 40 shown in FIG. 6 and the positioning component 230 shown in FIG. 10.

The positioning component may also have an angular U shape, instead of a cylindrical shape, in which a pair of fixing bases having a predetermined width face each other across an inner space. In such a case, band-shaped metal layers that face each other with a gap therebetween and that respectively correspond to the fixed bases are formed on the motherboard 21. Also in this case, the self alignment function can be obtained.

Figure 18:
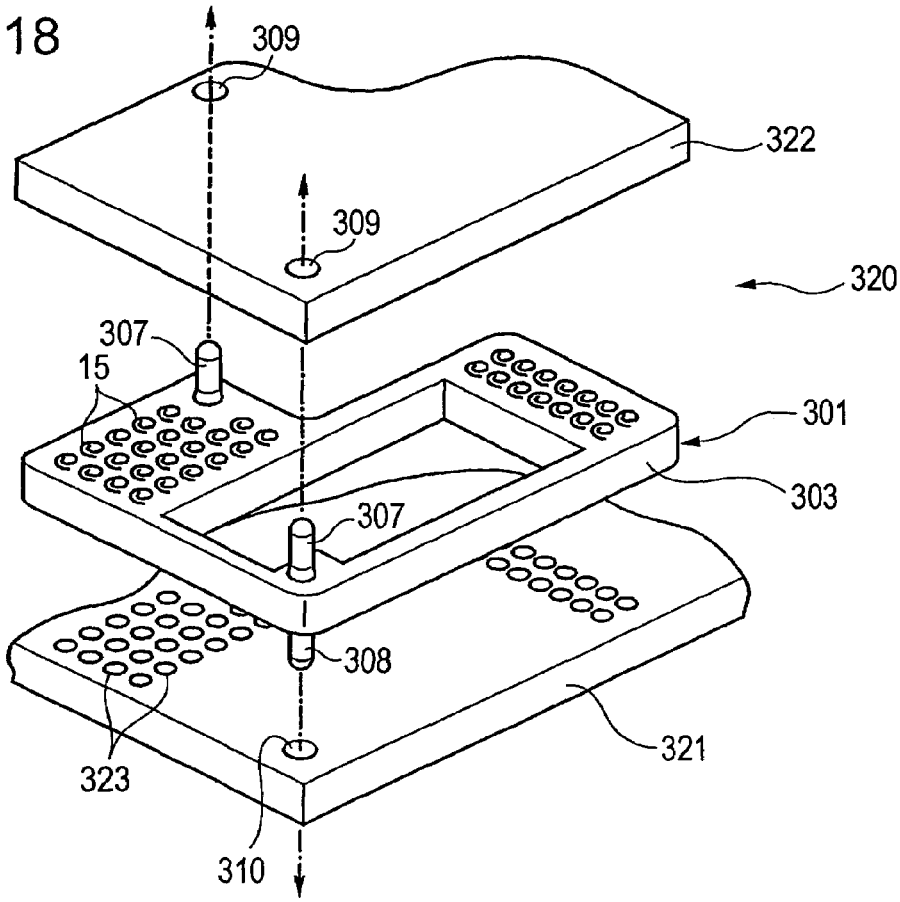
FIG. 18 is an exploded perspective view of a circuit connecting device according to a fourth embodiment of the present invention.

FIG. 18 is a perspective view illustrating a circuit connecting device 320 according to a fourth embodiment of the present invention.

A plurality of elastic contacts 15 forming a first elastic contact group are provided on a top face of a board-shaped support member 303 included in a connecting element 301, and a plurality of elastic contacts forming a second elastic contact group are provided on a bottom face of the support member 303. The elastic contacts 15 on the top face of the support member 303 are conductively connected to the respective elastic contacts on the bottom face of the support member 303. Positioning projections 307 that project upward and a positioning projection 308 that projects downward are formed integrally with the support member 303.

A first circuit board 321 and a second circuit board 322 are provided as circuit components. A plurality of conducting portions 323 corresponding to the elastic contacts on the bottom face of the connecting element 301 are provided on a top face of the first circuit board 321, and a plurality of conducting portions corresponding to the elastic contacts 15 on the top face of the connecting element 301 are provided on a bottom face of the second circuit board 322. In addition, the first circuit board 321 has a positioning hole 310 and the second circuit board 322 has positioning holes 309.

The positioning projection 308 is fitted to the positioning hole 310 without a gap or with a minimum gap, and the positioning projections 307 are fitted to the respective positioning holes 309 without a gap or with a minimum gap, so that the connecting element 301 is positioned with respect to the first circuit board 321 and the second circuit board 322. Accordingly, the elastic contacts provided on the bottom face of the connecting element 301 come into contact with the respective conducting portions 323 on the first circuit board 321, and the elastic contacts 15 provided on the top face of the connecting element 301 come into contact with the respective conducting portions on the bottom face of the second circuit board 322.

Figure 19:
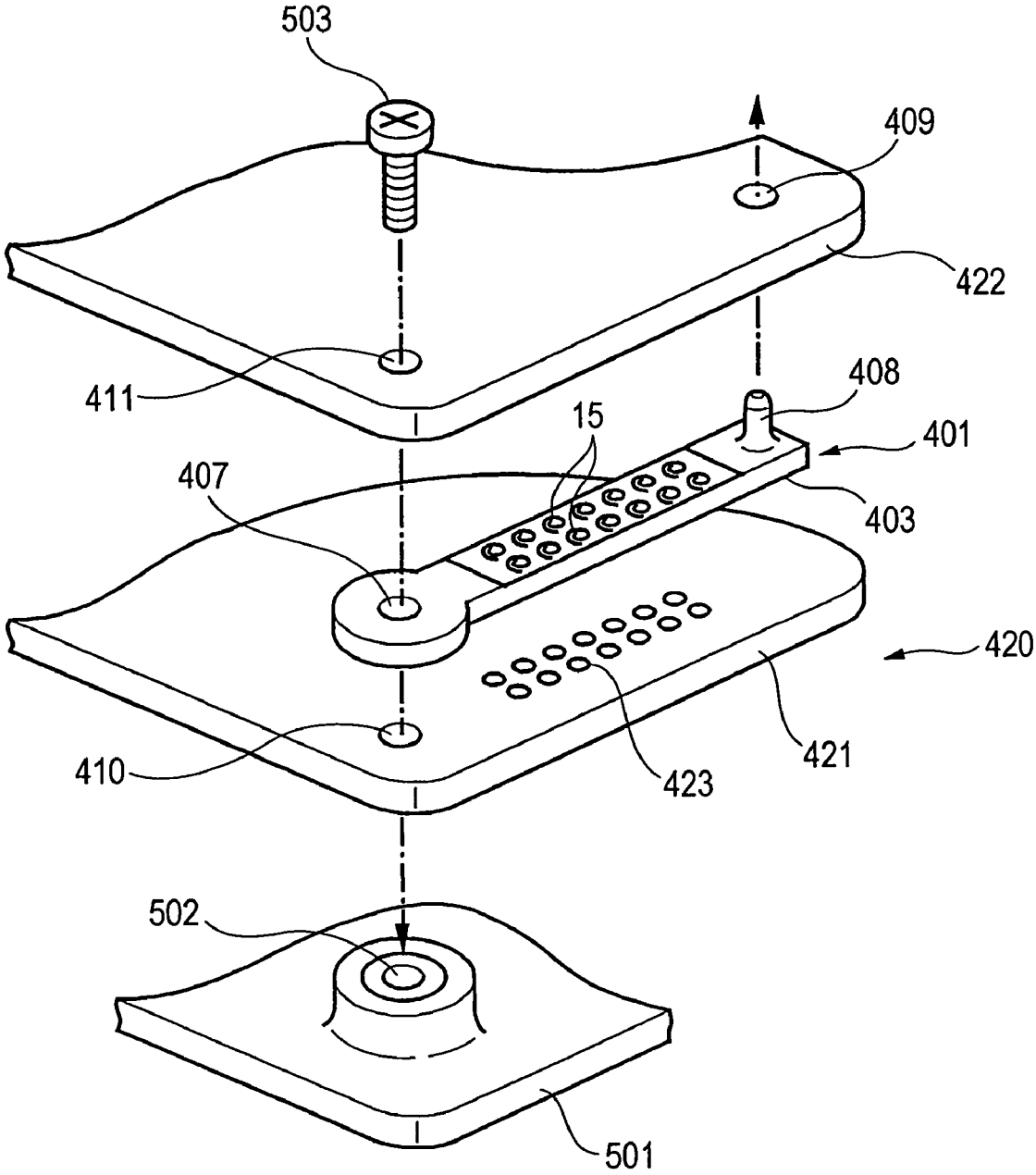
FIG. 19 is an exploded perspective view of a circuit connecting device according to a fifth embodiment of the present invention.

FIG. 19 is an exploded perspective view illustrating a circuit connecting device 420 according to a fifth embodiment of the present invention.

A connecting element 401 is obtained by wrapping the connecting sheet 10 shown in FIG. 3 around a support member 403 and fixing the connecting sheet 10 to the support member 403. The support member 403 is provided with a positioning projection 408 and a positioning hole 407. A plurality of conducting portions 423 are formed on a face of a first circuit board 421, which is a circuit component, and a mounting hole 410 is formed in the first circuit board 421. In addition, a second circuit board 422, which is another circuit component, has a positioning hole 409 and a mounting hole 411.

The positioning projection 408 on the connecting element 401 is fitted to the positioning hole 409 formed in the second circuit board 422, so that the connecting element 401 and the second circuit board 422 are positioned. In addition, an attachment screw 503 is inserted through the mounting hole 411 formed in the second circuit board 422, the positioning hole 407 formed in the connecting element 401, and the mounting hole 410 formed in the first circuit board 421, and is screwed into a screw hole 502 formed in a housing 501.

Accordingly, the connecting element 401 is positioned and attached to the first circuit board 421 and second circuit board 422. In addition, elastic contacts provided on a bottom face of the connecting element 401 come into contact with the conducting portions 423 on the first circuit board 421, and elastic contacts 15 provided on a top face of the connecting element 401 come into contact with conducting portions provided on a bottom face of the second circuit board 422.

The present invention is not limited to the above-described embodiments. For example, in the embodiments shown in FIGS. 1 to 10, an upper circuit board or the like may also be used in place of the electronic component 22 as an upper circuit component. In addition, in the circuit connecting device 20 shown in FIG. 6, for example, the structure may also be such that the electronic component 22 is not attached. More specifically, only the elastic contacts 16 may be provided on the second opposing face 3*b* of the connecting element 1, and the connecting element 1 may be positioned with respect to the motherboard 21 by the first positioning component 30 such that the conducting portions 23 on the motherboard 21 are connected to one another by the elastic contacts 16.

In addition, the elastic contacts are not limited to those having a spiral shape that swells upward, and arm-shaped elastic contacts that can generate an elastic force may also be used.

In addition, in the connecting sheet 10 shown in FIG. 3, the elastic contacts 15 included in the first elastic contact group 12 are connected to the respective elastic contacts 16 included in the second elastic contact group 13 in one-to-one correspondence by the wiring pattern 14. However, the elastic contacts 15 and the elastic contacts 16 may all be connected to one another by a single wiring pattern 14.

Alternatively, different numbers of elastic contacts 15 and elastic contacts 16 may be conductively connected to one another by the same wiring pattern 14. This may also be applied to the elastic contacts 15 and the fixed contacts 216 provided on the connecting sheet 210 shown in FIG. 8.

What is claimed is:

1. A circuit connecting device comprising:

a connecting element for connection with a circuit component including a support member having an opposing face; and a plurality of elastic contacts provided on the opposing face, wherein the support member has a positioning hole, a positioning recess, or a positioning projection in a region free from the elastic contacts; and a position component for positioning the connecting element, wherein the positioning component is attachable to the circuit component having conducting portions to which the elastic contacts are connected, wherein the circuit component has a metal layer for positioning, the positioning component being soldered on the metal layer, and wherein the connecting element is positioned and attached to the circuit component by the positioning component.

2. The circuit connecting device according to Claim 1, wherein the positioning component and the support member are fitted to each other so that the connecting element is positioned with respect to the circuit component.

3. The circuit connecting device according to Claim 1, wherein the conducting portions and the metal layer for positioning are made of the same metal material in the same process.

4. The connecting element according to claim 1, wherein the first group of elastic contacts, the second group of elastic contacts, and a wiring pattern for conductively connecting the first group of elastic contacts to the second group of elastic contacts are provided on one side of a flexible substrate, the flexible substrate being fixed to the support member in a bent fashion so that the first group of elastic contacts are positioned on said one of the opposing faces and the second group of elastic contacts are positioned on said other one of the opposing faces.

5. The connecting element according to claim 4, further comprising positioning means for positioning the flexible substrate with respect to the support member and fixing the flexible substrate to the support member.

6. The connecting element according to claim 1, wherein the opposing face is provided at each of two opposite sides of the support member, and wherein the elastic contacts are provided on one of the opposing faces and a plurality of fixed contacts are provided on the other one of the opposing faces, the elastic contacts being conductively connected to the fixed contacts.

7. The connecting element according to claim 6, wherein the elastic contacts, the fixed contacts, and a wiring pattern for conductively connecting the elastic contacts to the fixed contacts are provided on one side of a flexible substrate, the flexible substrate being fixed to the support member in a bent fashion so that the elastic contacts are positioned on said one of the opposing faces and the fixed contacts are positioned on said other one of the opposing faces.

8. A circuit connecting device comprising:

the connecting element according to claim 3;

a first positioning component for positioning the connecting element; and a second positioning component for positioning the connecting element, wherein the support member has a positioning hole to which the first positioning component or the second positioning component is fitted, wherein the first positioning component and the second positioning are capable of being fitted to each other, and wherein the first positioning component is attachable to a first circuit component having conducting portions to which the elastic contacts are connected and the second positioning component is attachable to a second circuit component having conducting portions to which the fixed contacts are connected.

9. The circuit connecting device according to claim 1, wherein the positioning component includes fixing bases that face each other across an inner space and that have a predetermined width in an opposing direction in which the fixing bases face each other, and wherein the metal layer provided on the circuit component includes portions having a predetermined width and spaced from each other in said opposing direction, the fixing bases being soldered on the portions of the metal layer such that the fixing bases are in surface contact with the portions of the metal layer.

10. The circuit connecting device according to claim 9, wherein a distance between outer peripheral edges of the portions of the metal layer in said opposing direction is equal to or more than a distance between outer peripheral edges of the fixing bases in said opposing direction, and a distance between inner peripheral edges of the portions of the metal layer in said opposing direction is equal to or less than a distance between inner peripheral edges of the fixing bases in said opposing direction.

11. The circuit connecting device according to claim 10, wherein a difference between the distance between the outer peripheral edges of the portions of the metal layer in said opposing direction and the distance between the outer peripheral edges of the fixing bases in said opposing direction is in the range of 0 mm to 0.3 mm, and wherein a difference between the distance between the inner peripheral edges of the portions of the metal layer in said opposing direction and the distance between the inner peripheral edges of the fixing bases in said opposing direction is in the range of 0 mm to 0.3 mm.

12. The circuit connecting device according to claim 1, wherein the positioning component includes an annular fixing base that is provided so as to surround an inner space and that has a predetermined width, and wherein the metal layer provided on the circuit component has an annular shape with a predetermined width, the fixing base being soldered on the metal layer such that the fixing base is in surface contact with the metal layer.

13. The circuit connecting device according to claim 12, wherein a diameter of an outer peripheral edge of the metal layer is equal to or more than a diameter of an outer peripheral edge of the fixing base, and a diameter of an inner peripheral edge of the metal layer is equal to or less than a diameter of an inner peripheral edge of the fixing base.

14. The circuit connecting device according to claim 13, wherein a difference between the diameter of the outer peripheral edge of the metal layer and the diameter of the outer peripheral edge of the fixing base is in the range of 0 mm to 0.3 mm, and wherein a difference between the diameter of the inner peripheral edge of the metal layer and the diameter of the inner peripheral edge of the fixing base is in the range of 0 mm to 0.3 mm.

15. A circuit connecting device comprising:

a connecting element for connection with a circuit component including a support member having an opposing face; and a plurality of elastic contacts provided on the on opposing face, wherein the support member has a positioning hole, a position recess, or a positioning projection in a region free from the elastic contacts, wherein the opposing face is provided on each of two opposite sides of the support member, and wherein the elastic contacts include a first group of elastic contacts provided on one of the opposing faces and a second group of elastic contacts provided on the other one of the opposing faces, the first group of elastic contacts being conductively connected to the second group of elastic contacts;

a first positioning component for positioning the connecting element; and a second positioning component for positioning the connecting element, wherein the support member has a positioning hole to which the first positioning component or the second positing component is fitted, wherein the first positioning component and the second positioning are capable of being fitted to each other, wherein the first positioning component is attachable to a first circuit component having conducting portions to which the first group of elastic contacts are connected and the second positioning component is attachable to a second circuit component having conducting portions to which the second group of elastic contacts are connected, and wherein each of the first circuit component and the second circuit component has a metal layer for positioning, the first positioning component and the second positioning component being soldered on the metal layer on the first circuit component and the metal layer on the second circuit component, respectively, and wherein the first positioning component and the second positioning component are fitted to each other such that the connecting element is positioned and attached between the first circuit component and the second circuit component.

* * * * *